US010151468B2

(12) United States Patent
Watanabe et al.

(10) Patent No.: US 10,151,468 B2
(45) Date of Patent: Dec. 11, 2018

(54) LIGHTING DEVICE

(71) Applicant: APS Japan Co., Ltd., Osaka-shi, Osaka (JP)

(72) Inventors: Hidemitsu Watanabe, Osaka (JP); Hisanori Kawasaki, Osaka (JP); Hiroyuki Watanabe, Osaka (JP)

(73) Assignee: APS JAPAN CO., LTD., Osaka-shi (JP)

( * ) Notice: Subject to any disclaimer, the term of this patent is extended or adjusted under 35 U.S.C. 154(b) by 1315 days.

(21) Appl. No.: 13/750,296

(22) Filed: Jan. 25, 2013

(65) Prior Publication Data

US 2013/0207542 A1 Aug. 15, 2013

(30) Foreign Application Priority Data

Jan. 26, 2012 (JP) ..... 2012-013700
Jan. 26, 2012 (JP) ..... 2012-013752

(51) Int. Cl.

| | |
|---|---|
| ***F21V 29/507*** | (2015.01) |
| ***F21V 29/67*** | (2015.01) |
| ***F21V 29/00*** | (2015.01) |
| ***F21V 29/70*** | (2015.01) |
| ***F21V 29/83*** | (2015.01) |
| ***F21K 9/23*** | (2016.01) |
| *F21K 9/237* | (2016.01) |
| *F21K 9/238* | (2016.01) |
| *F21Y 115/10* | (2016.01) |

(52) U.S. Cl.

CPC ..... *F21V 29/507* (2015.01); *F21K 9/23* (2016.08); *F21V 29/20* (2013.01); *F21V 29/67* (2015.01); *F21V 29/70* (2015.01); *F21V 29/83* (2015.01); *F21K 9/237* (2016.08); *F21K 9/238* (2016.08); *F21Y 2115/10* (2016.08)

(58) Field of Classification Search

CPC ..... F21K 9/135; F21K 9/1355; F21K 9/30; F21K 9/23; F21K 9/237; F21K 9/238; F21V 29/02; F21V 29/20; F21V 29/40; F21V 29/503; F21V 29/507; F21V 29/508; F21V 29/57; F21V 29/60; F21V 29/67; F21V 29/673; F21V 29/677; F21V 29/717; F21V 29/74; F21V 29/745; F21V 29/75; F21V 29/77; F21V 29/773; F21V 29/777; F21V 29/78; F21V 29/83; F21V 29/90

USPC ..... 362/294, 373, 249.02, 363

See application file for complete search history.

(56) References Cited

U.S. PATENT DOCUMENTS 4,658,338 A * 4/1987 Bertozzi ..... 362/640
2007/0041195 A1* 2/2007 Chen ..... 362/294
(Continued)

FOREIGN PATENT DOCUMENTS

| | | |
|---|---|---|
| JP | 2003-178602 | 6/2003 |
| JP | 2010-086713 | 4/2010 |
| JP | 2011-108590 | 6/2011 |

*Primary Examiner* — Jong-Suk (James) Lee
*Assistant Examiner* — Zheng Song
(74) *Attorney, Agent, or Firm* — Kratz, Quintos & Hanson, LLP

(57) ABSTRACT

A lighting device that allows efficient heat discharge from a light source while avoiding accidents such as firing due to a flammable foreign object in contact with the light source or the like and failures such as reduction in luminous efficiency due to dust or the like adhered to and accumulated on the internal surface of a lens unit.

26 Claims, 24 Drawing Sheets

(56) References Cited

U.S. PATENT DOCUMENTS

| | | | | |
|---|---|---|---|---|
| 2008/0024067 | A1* | 1/2008 | Ishibashi | F21V 29/004 315/112 |
| 2009/0046433 | A1* | 2/2009 | Yu et al. | 361/719 |
| 2010/0165632 | A1* | 7/2010 | Liang | 362/294 |
| 2010/0188860 | A1* | 7/2010 | Liaw | 362/373 |
| 2010/0295436 | A1* | 11/2010 | Horng et al. | 313/46 |
| 2011/0074265 | A1* | 3/2011 | Van De Ven et al. | 313/46 |
| 2011/0089831 | A1* | 4/2011 | Takahasi et al. | 315/35 |
| 2011/0198068 | A1* | 8/2011 | Chen | 165/185 |
| 2012/0098402 | A1* | 4/2012 | Fu | 313/46 |
| 2012/0113597 | A1* | 5/2012 | Verplaetse et al. | 361/709 |
| 2012/0118550 | A1* | 5/2012 | Langlois | 165/185 |
| 2012/0140490 | A1* | 6/2012 | Rowlette et al. | 362/373 |
| 2012/0176032 | A1* | 7/2012 | Chu | 315/32 |
| 2012/0188745 | A1* | 7/2012 | Yoneda | F21K 9/135 362/84 |
| 2013/0188360 | A1* | 7/2013 | Chuang | F21V 29/83 362/294 |

* cited by examiner

[Fig. 1]
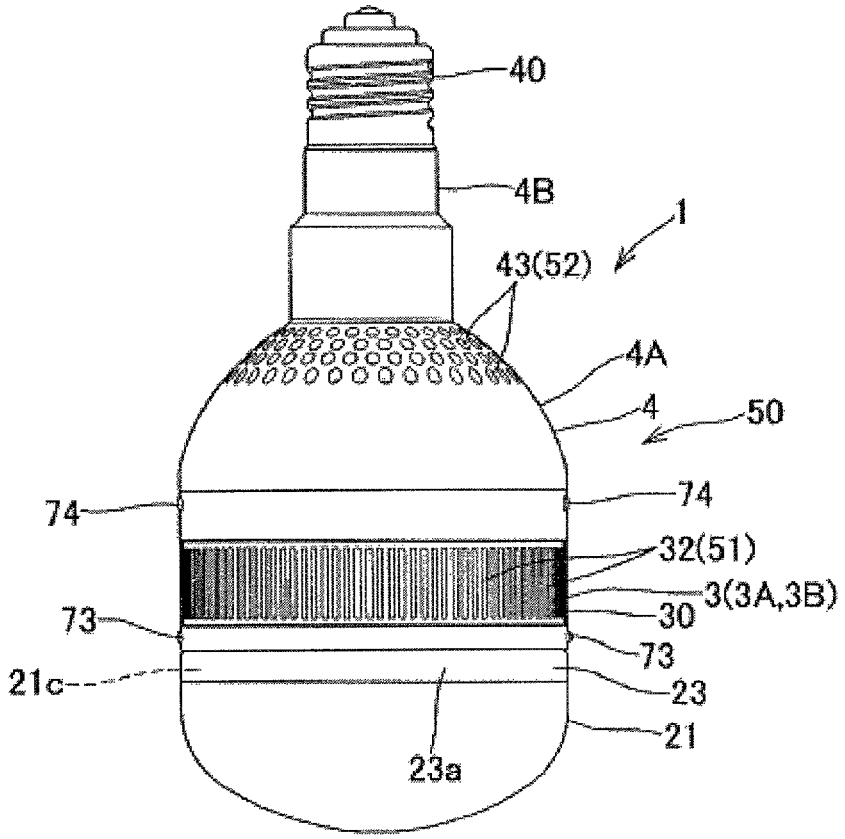

[Fig. 2]
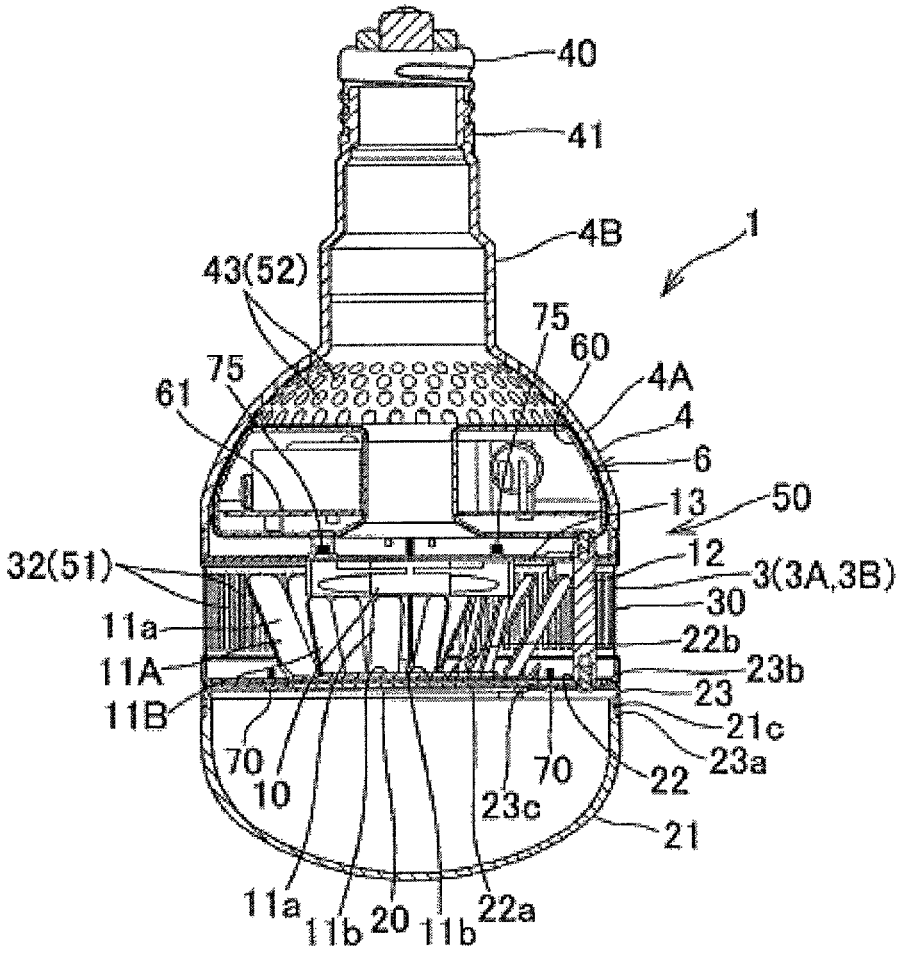

[Fig. 3]
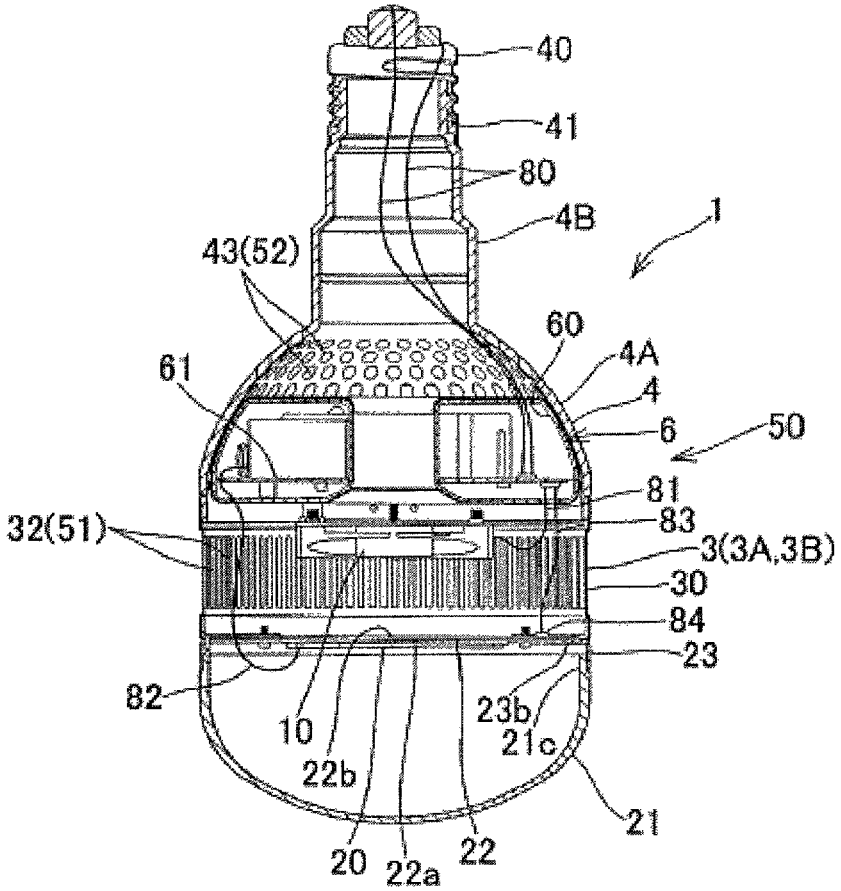

[Fig. 4]
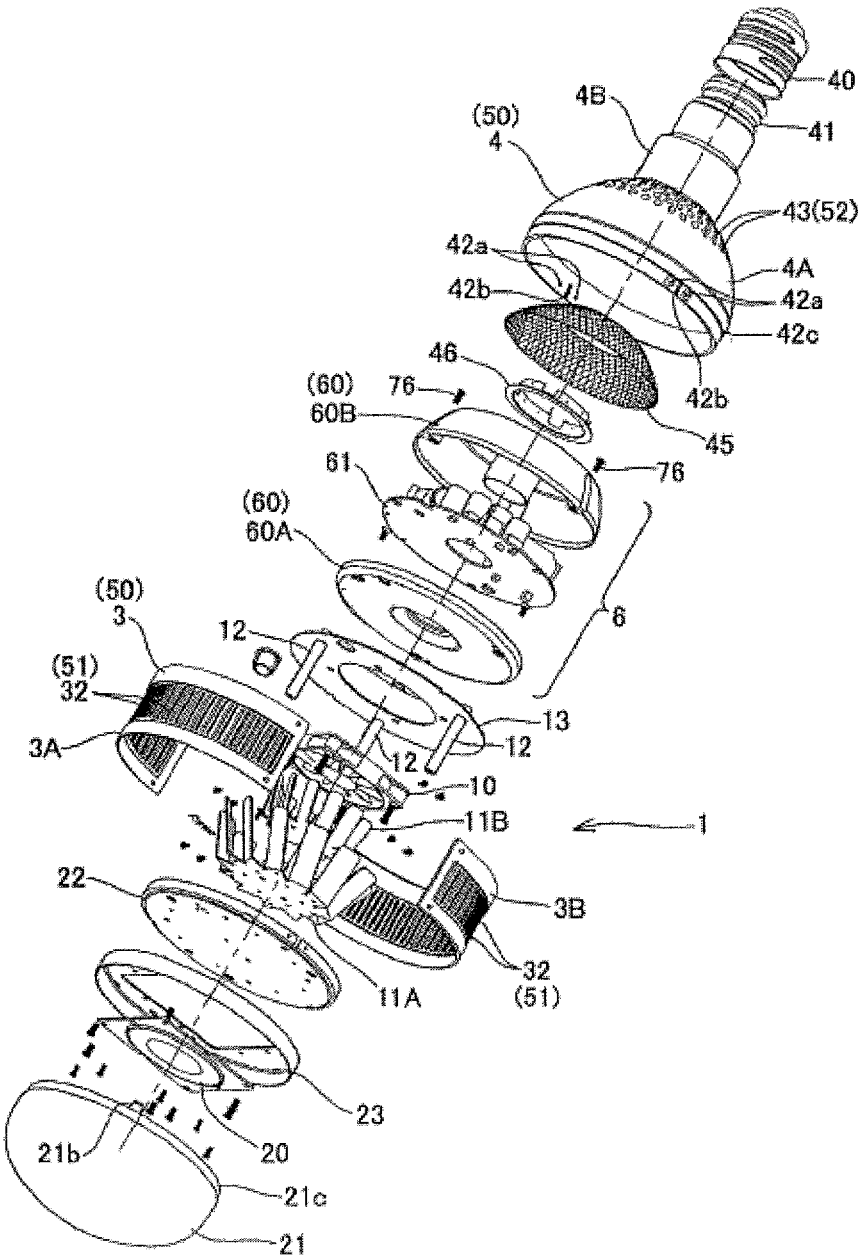

[Fig. 5]
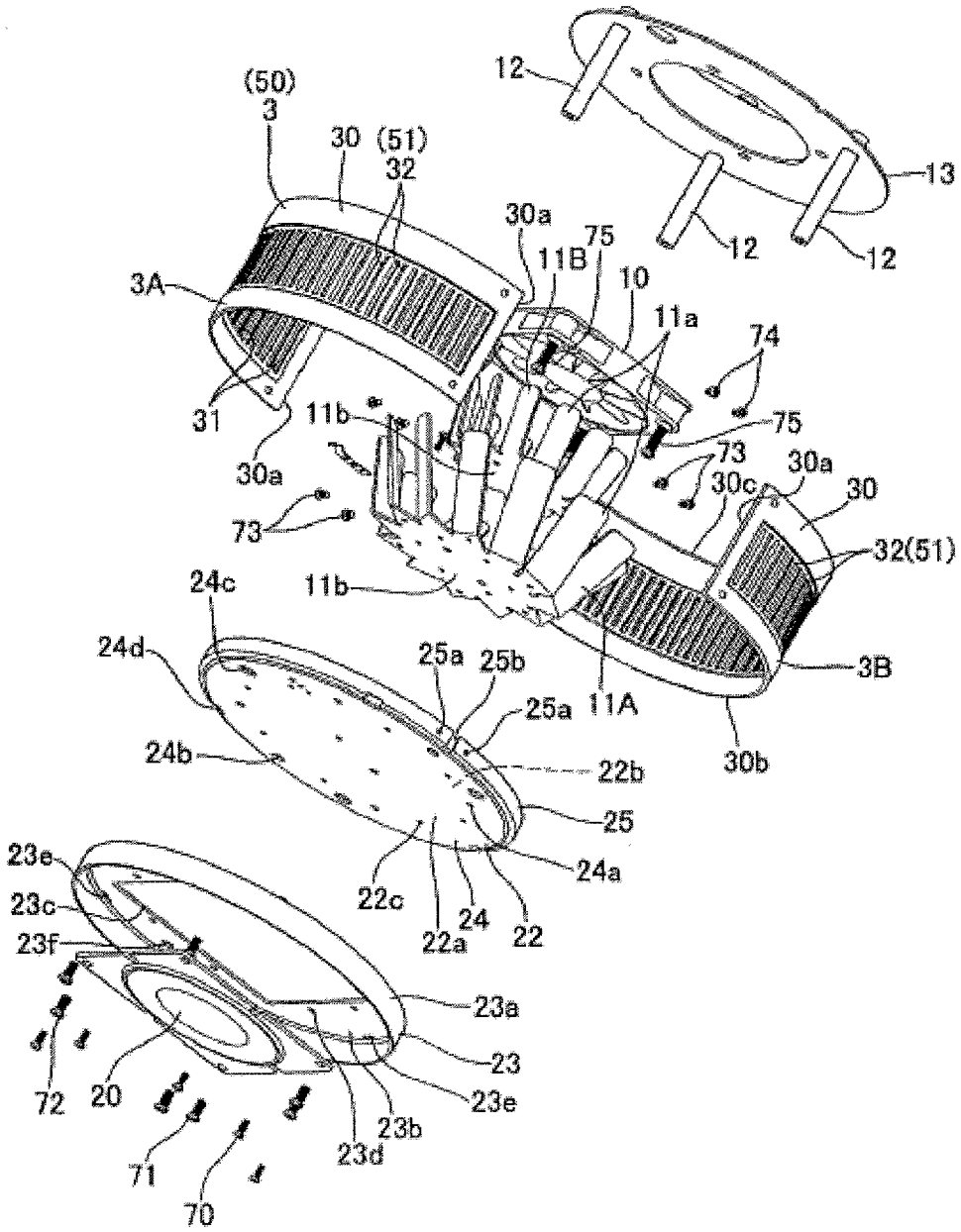

[Fig. 6]
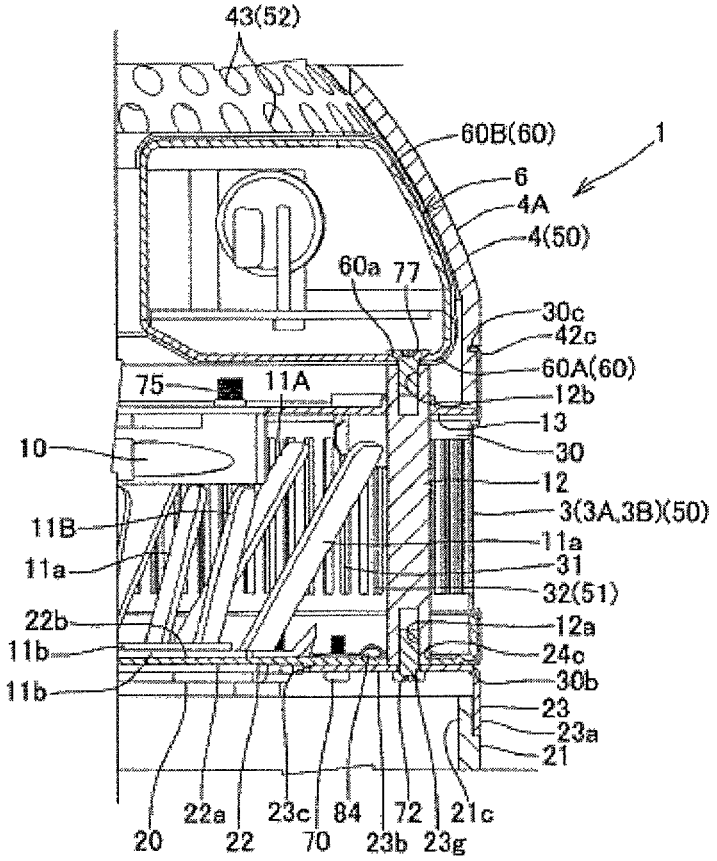
[Fig. 7]
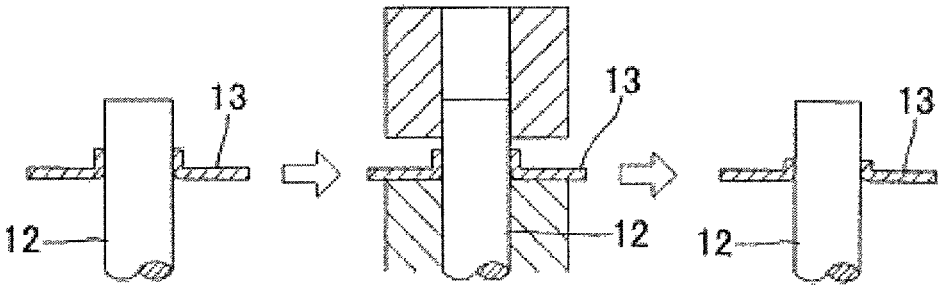

[Fig. 8]
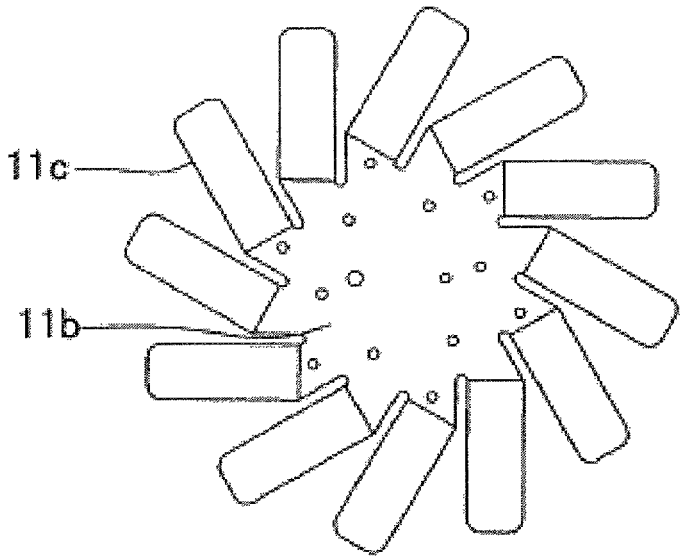
[Fig. 9]
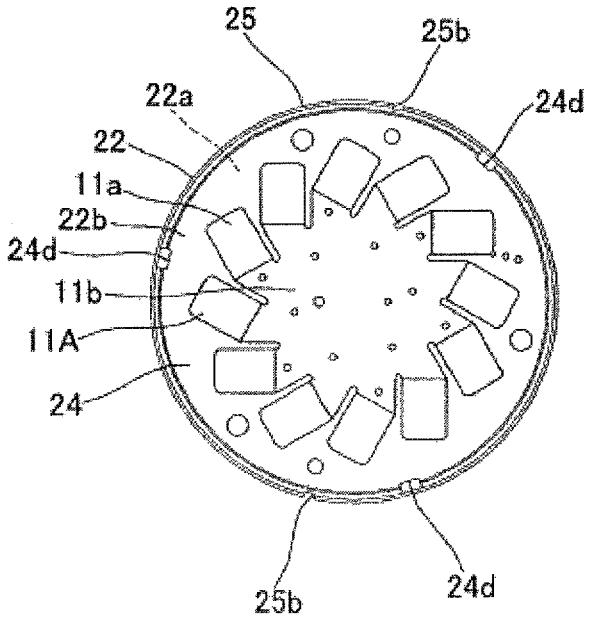

[Fig. 10]
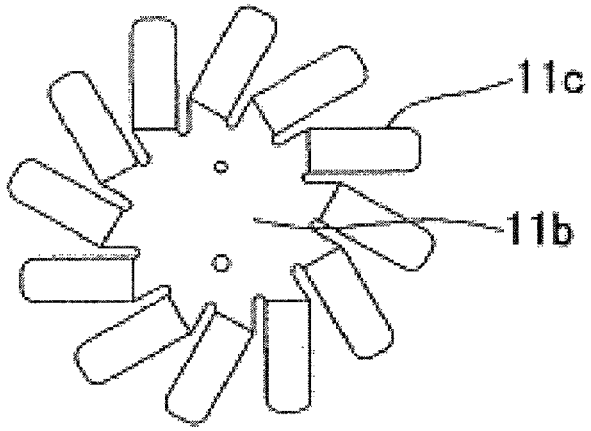
[Fig. 11]
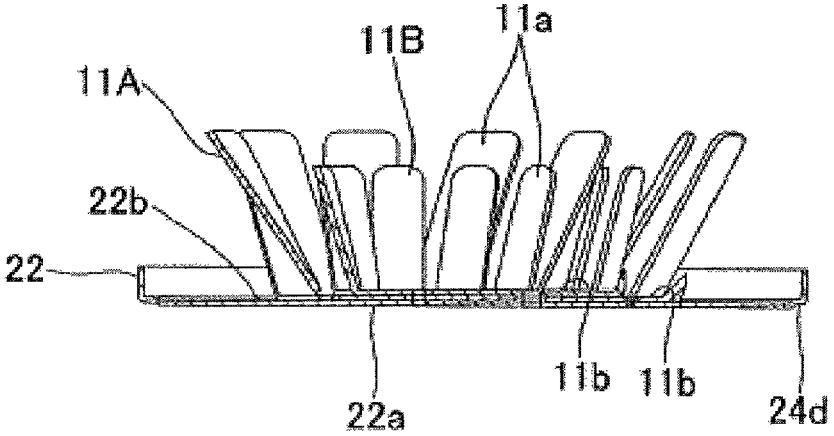

[Fig. 12]
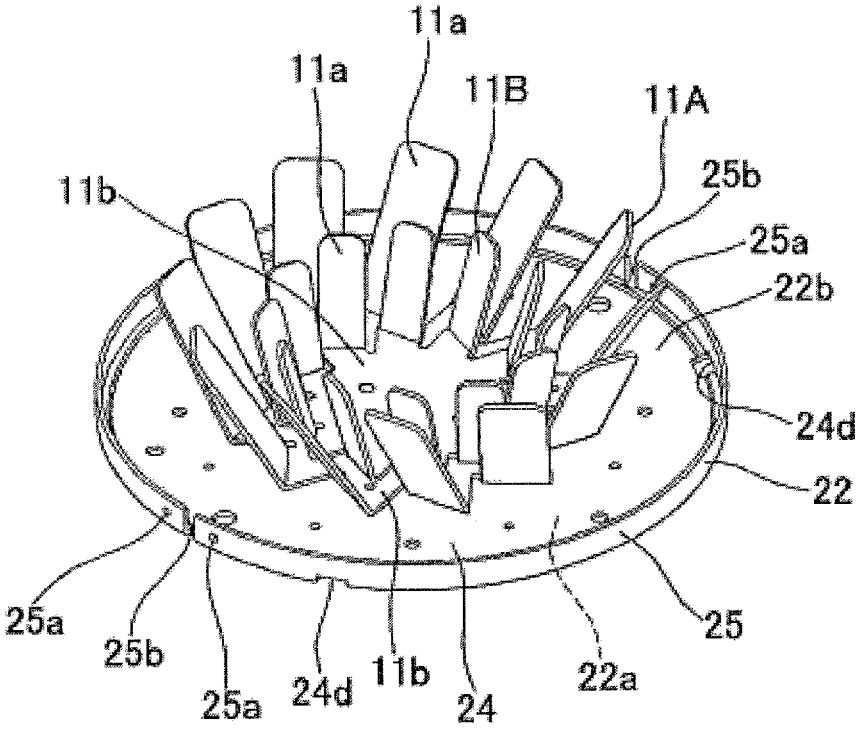

[Fig. 13]
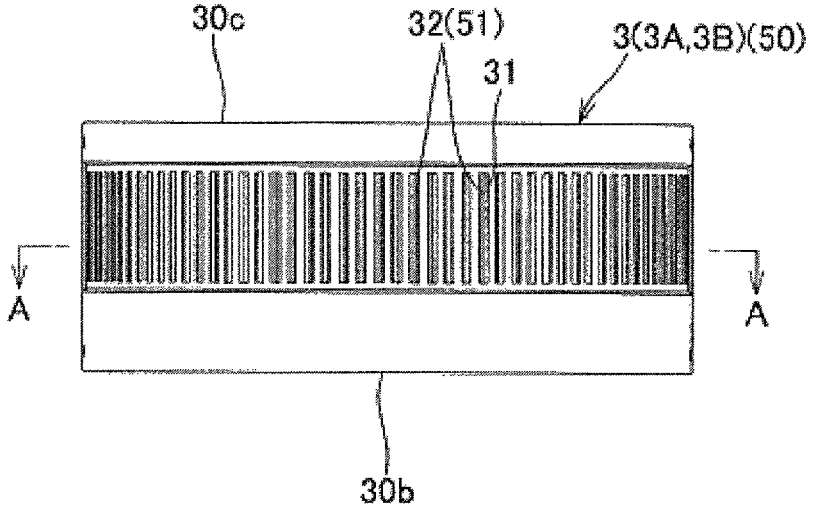
[Fig. 14]
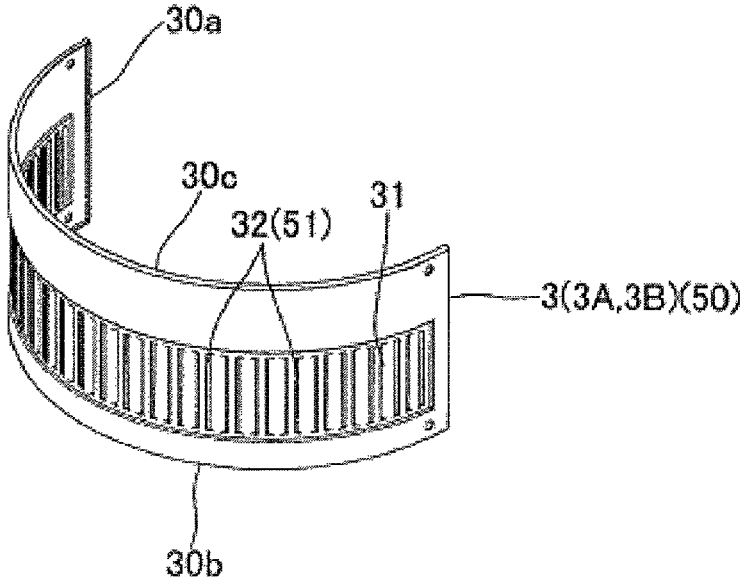

[Fig. 15]
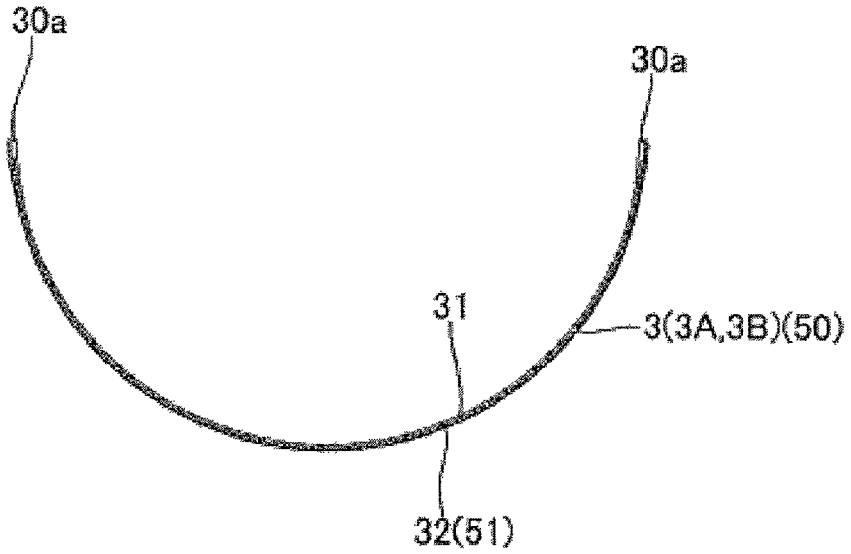
[Fig. 16]
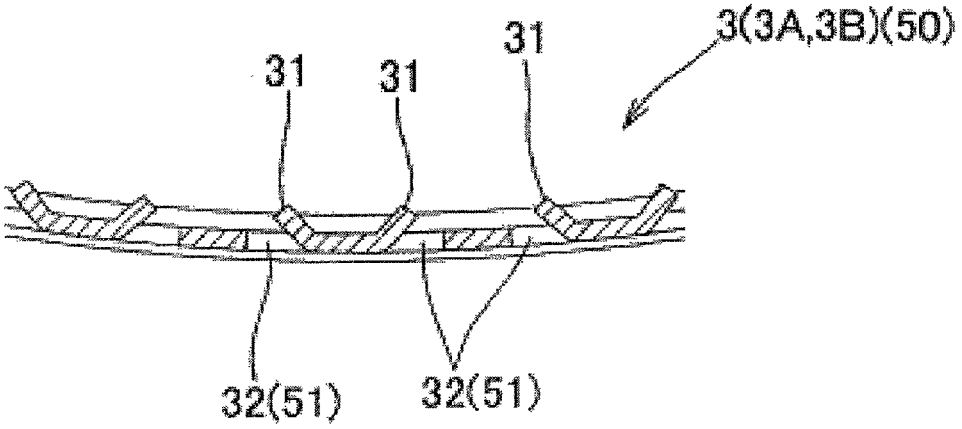

[Fig. 17]
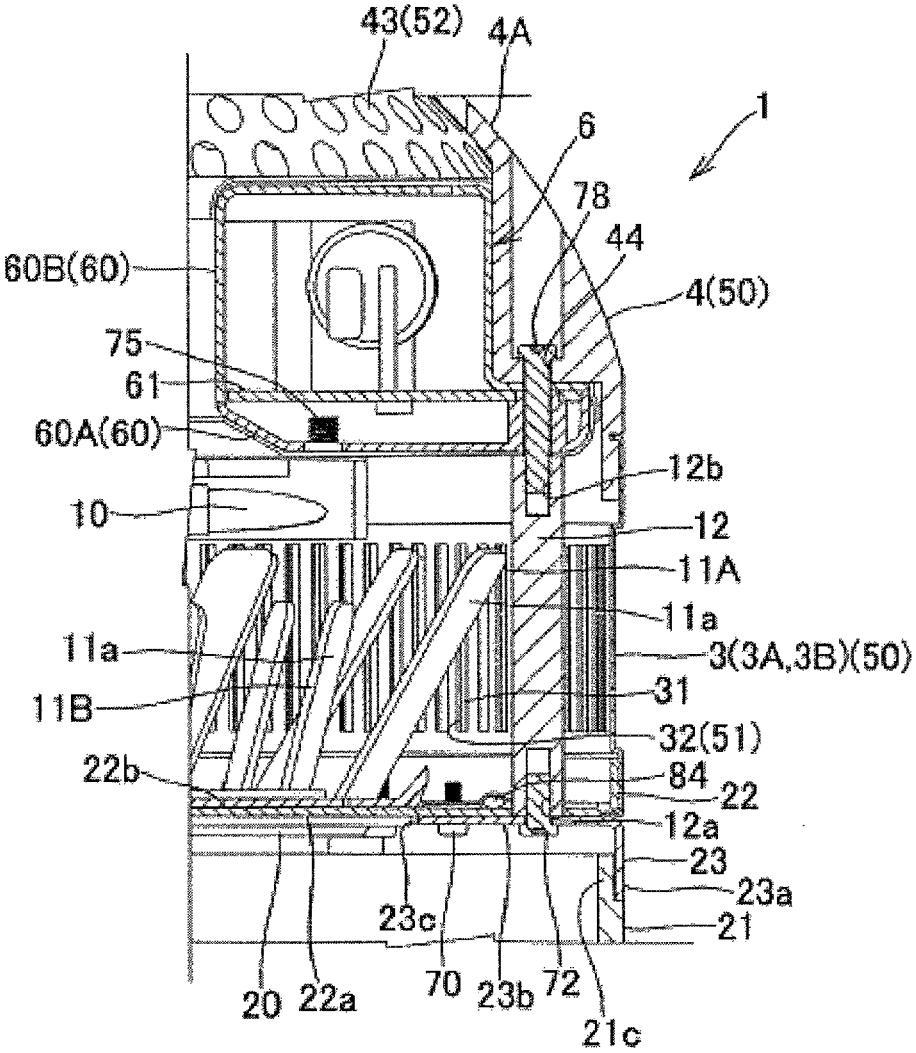

[Fig. 18]
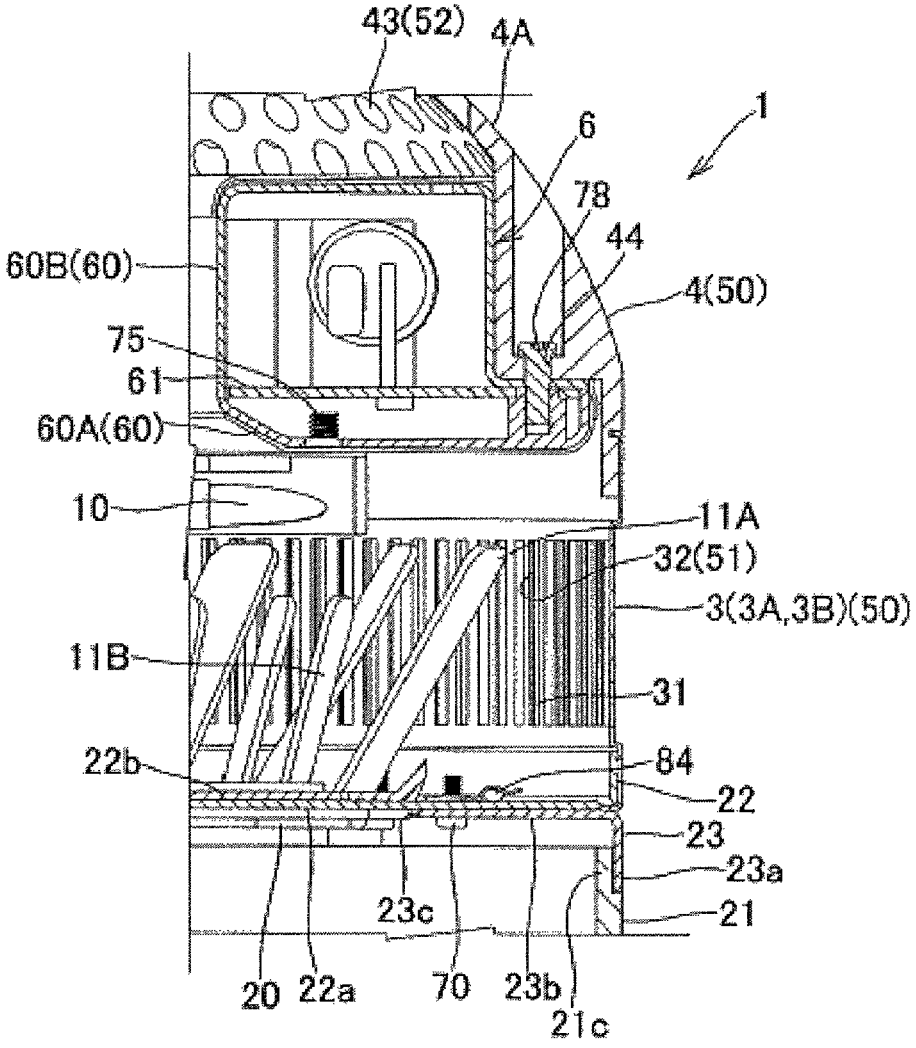

[Fig. 19]
(a)
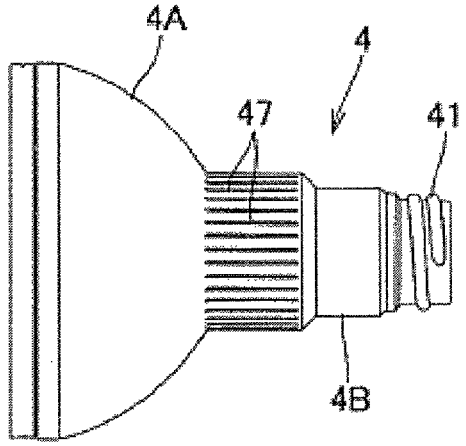
(b)
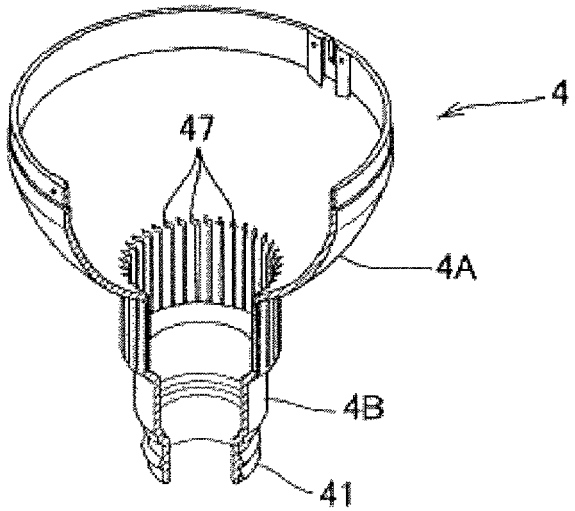

[Fig. 20]
(a)
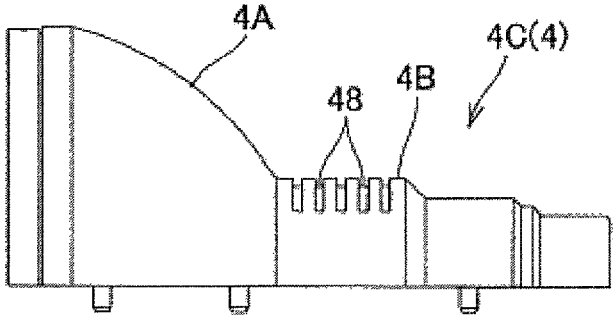
(a)
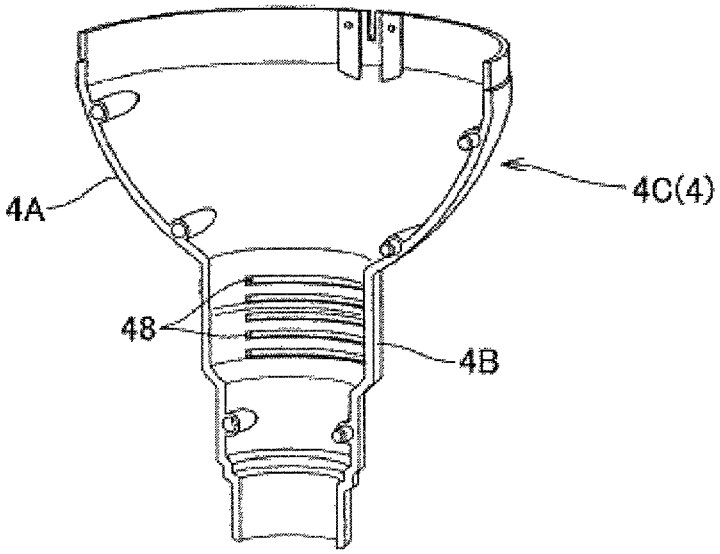

[Fig. 21]
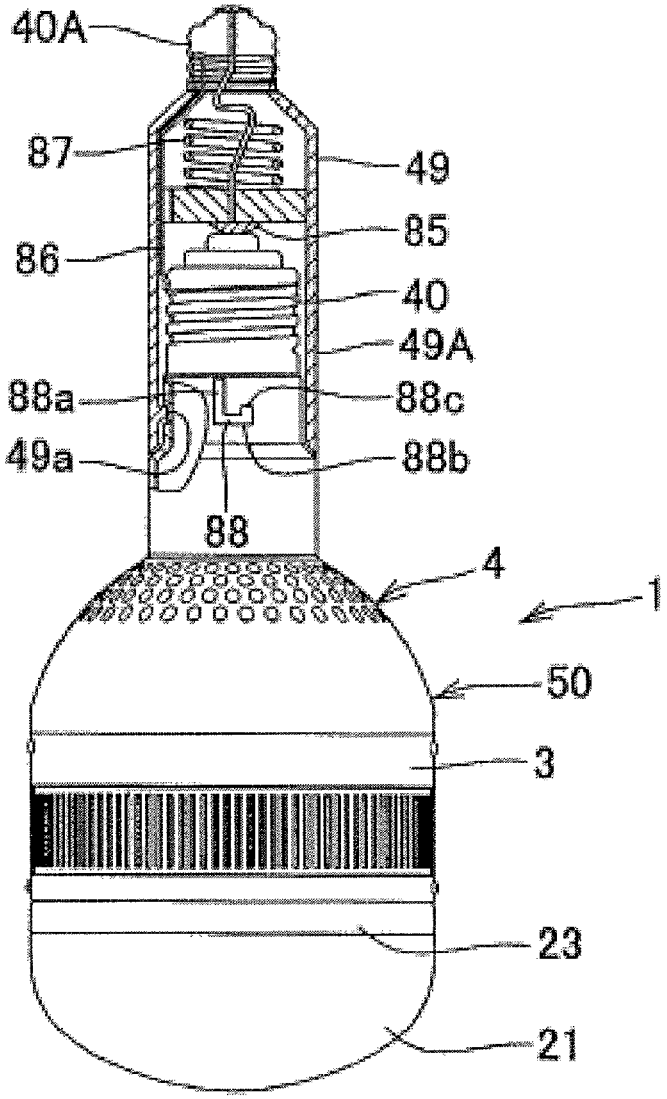

[Fig. 22]
(a)
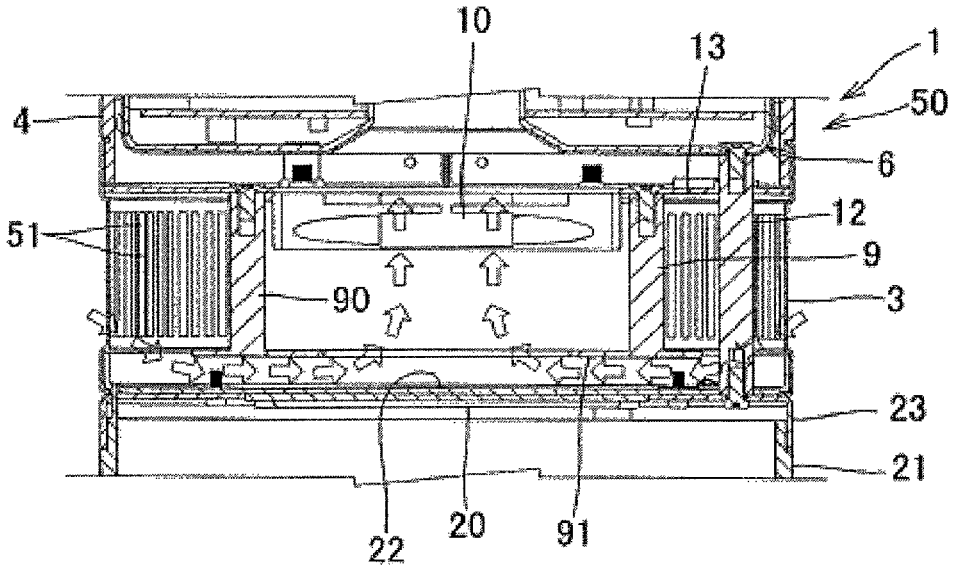
(b)
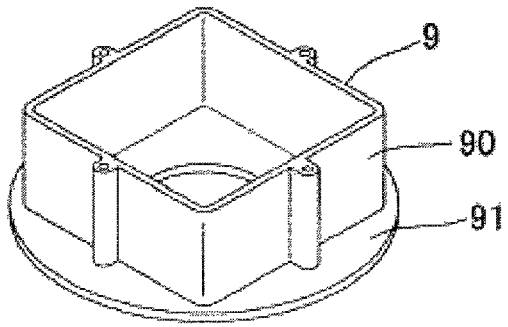

[Fig. 23]
(a)
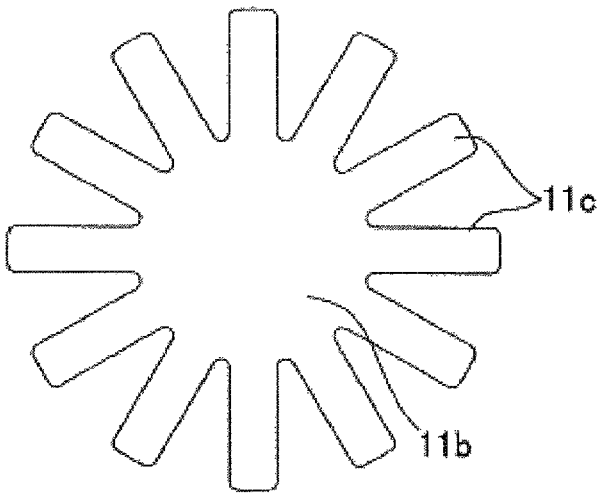
(b)
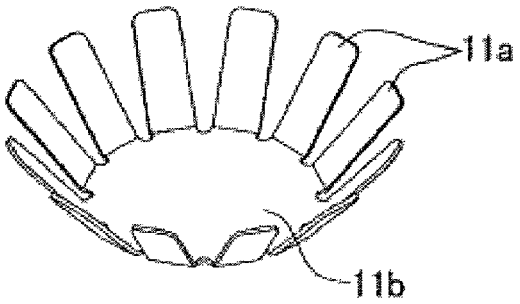

[Fig. 24]
(a)
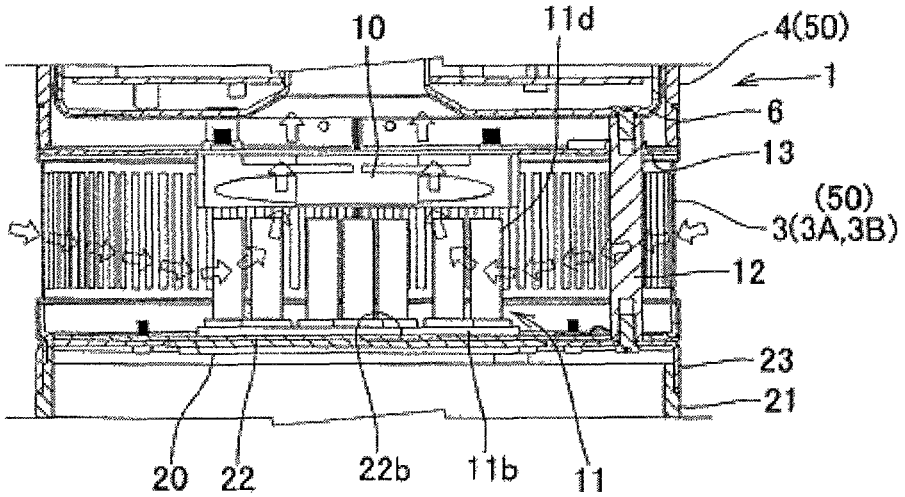
(b)
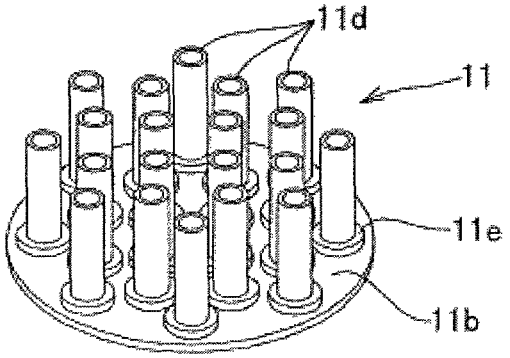

[Fig. 25]
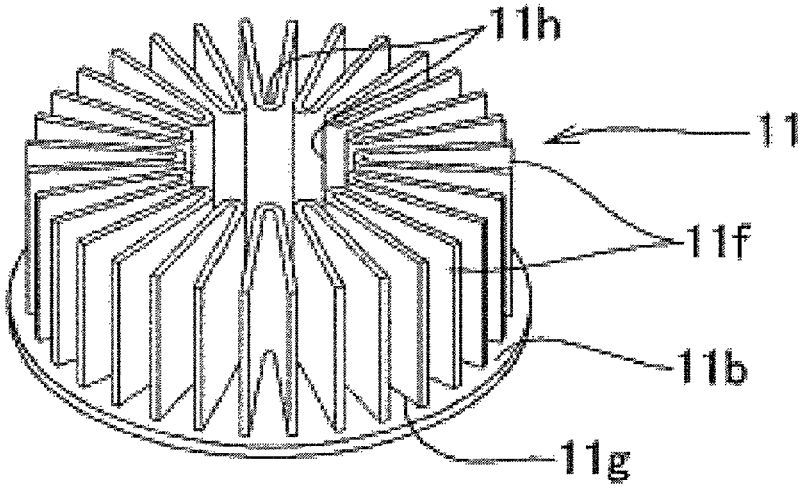
[Fig. 26]
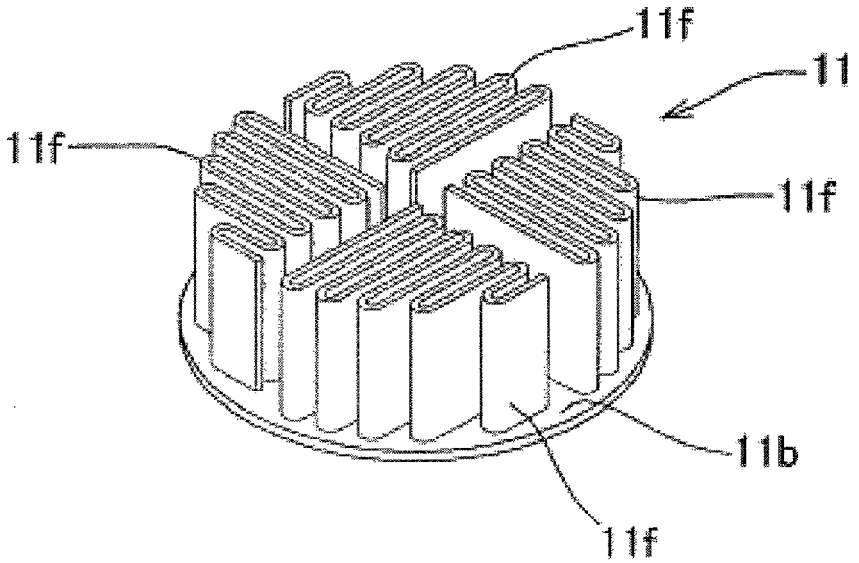

[Fig. 27]
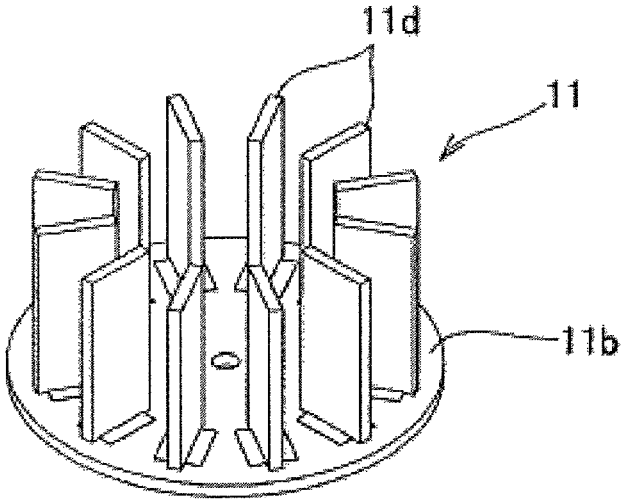
[Fig. 28]
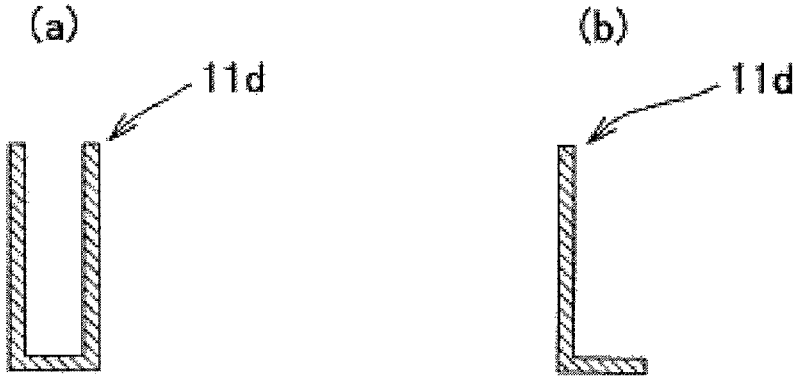

[Fig. 29]
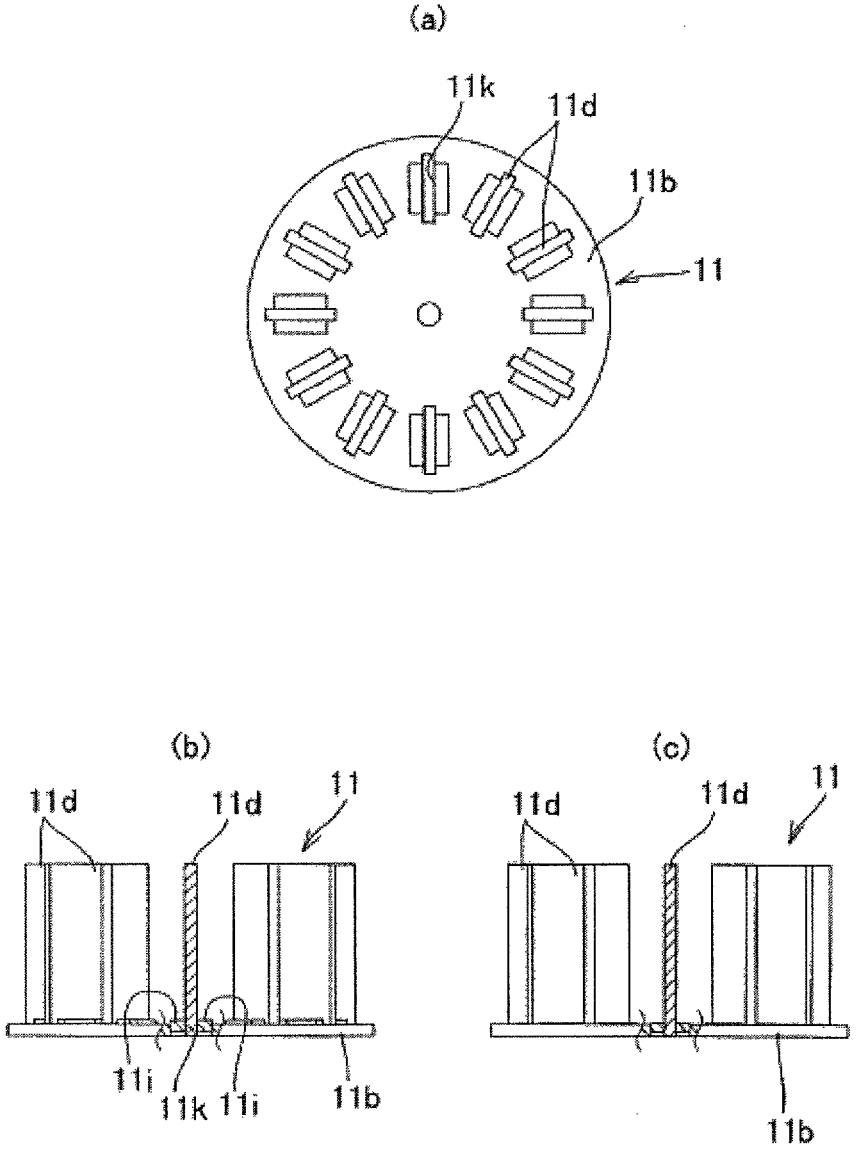

[Fig. 30]
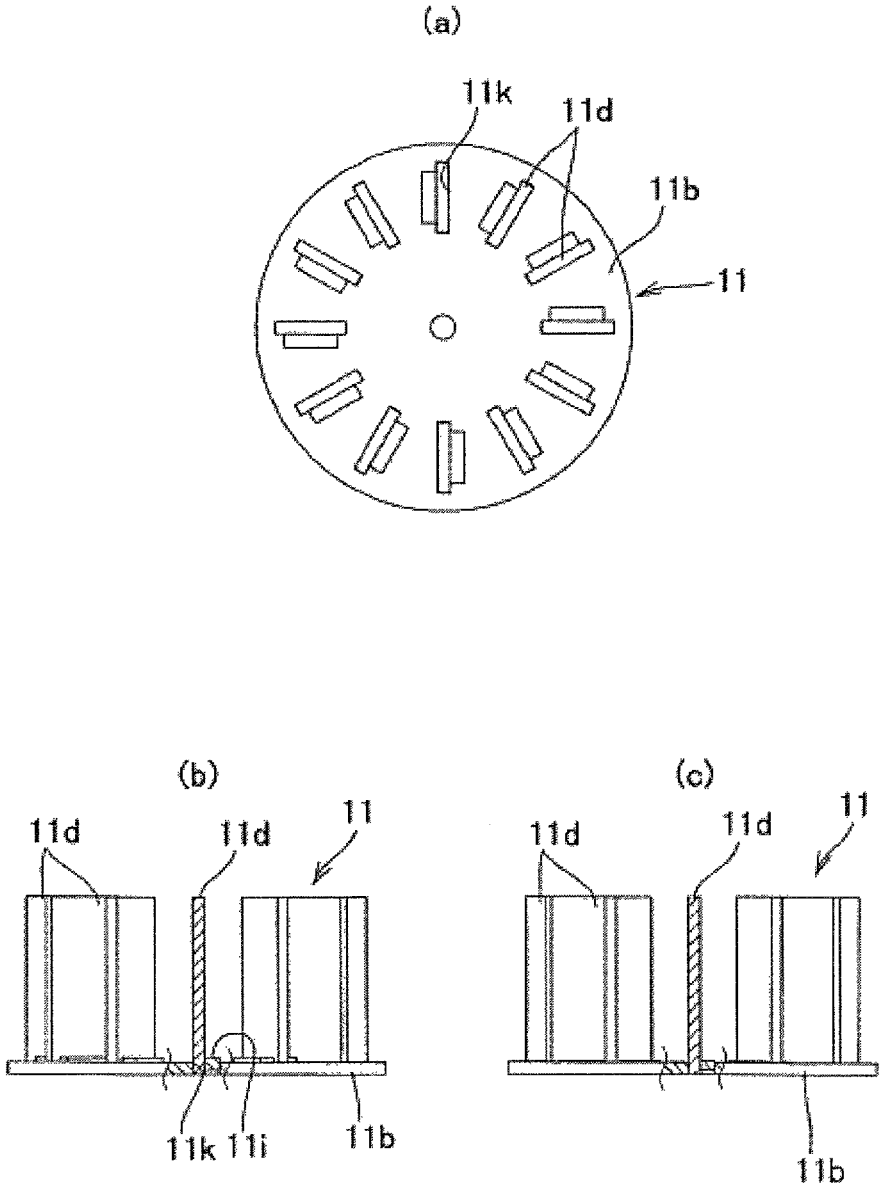

[Fig. 31]
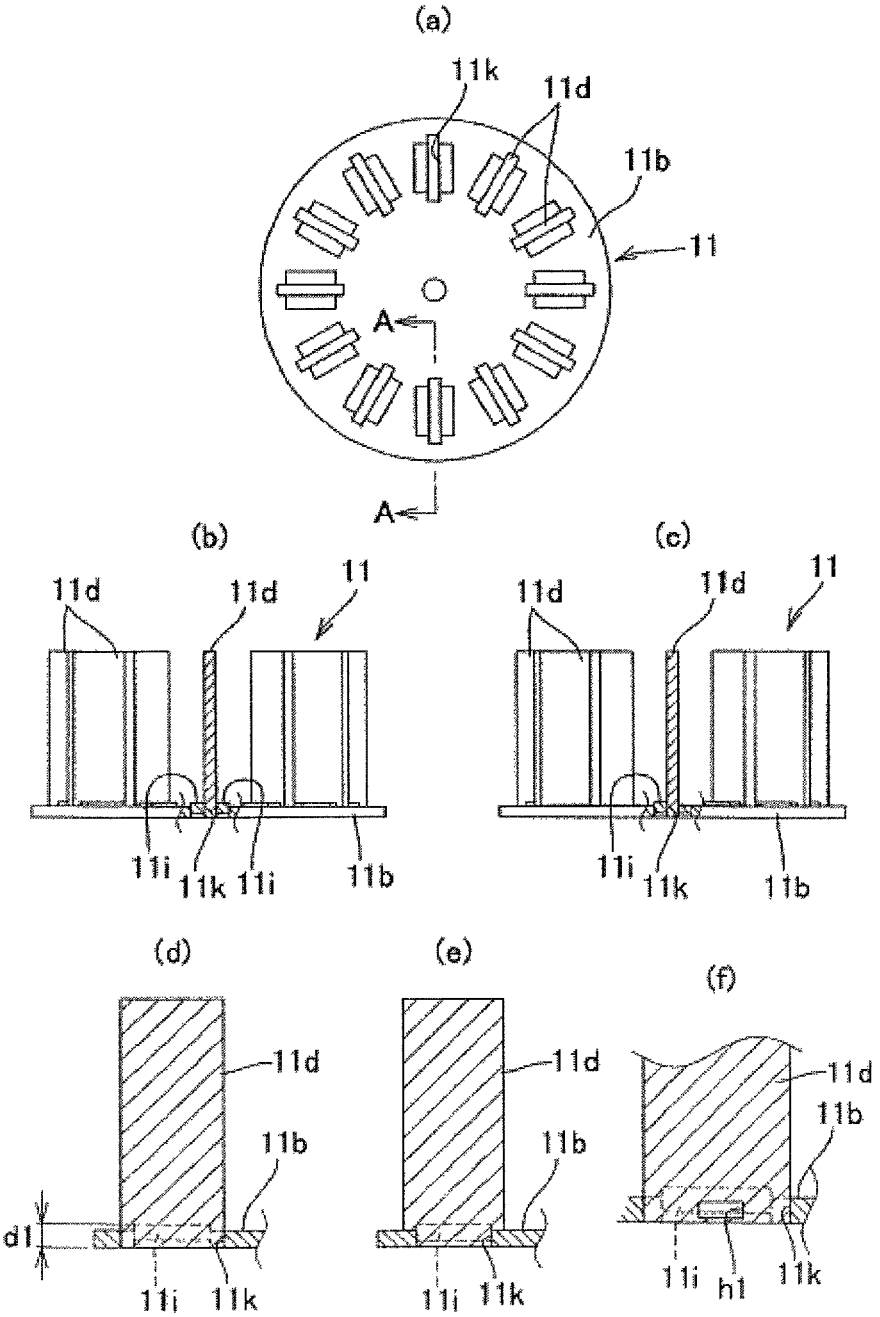

LIGHTING DEVICE

TECHNICAL FIELD

The present invention relates to a lighting device that has a lens unit covering a light source at a leading end side thereof.

BACKGROUND ART

In recent years, LED lighting devices for use in ordinary illumination or decoration have been provided with improved luminous efficiency of LEDs. Such LED lighting devices have an LED module with a plurality of LED elements surface-mounted at the leading end side of a housing and a translucent lens unit covering the module, and discharges outwardly radiation light from the LED elements. When the LED elements are raised in temperature to 90 degrees or more, their light power decreases or their life time becomes shorter. Accordingly, the preferred temperature of the LED elements is 50 degrees or less. In addition, a power circuit part for LEDs stored in the housing has a heat generator such as a capacitor, and it is known that, with abnormal temperature rise at the power circuit, the circuit may be deteriorated in operating reliability and life time.

Accordingly, conventional LED lighting devices are structured such that the housing has a metal heat dissipation part to prevent temperature rise at the LED elements and the power circuit, and to dissipate outwardly heat transferred from the LED elements and the power circuit. In particular, there has been suggested an LED lighting device in which a heat dissipation part has a heat sink formed by not an aluminum die-casting but a metal cylindrical main unit and a press-formed cooling fin part, and the LED lighting device is lightweight and excellent in heat dissipating property, and realizes significant reduction in manufacturing costs (refer to Patent Literature 1).

However, for example, if an LED lighting device is used instead of a mercury lamp to increase power output from a light source, heat generation also increases and hence it is difficult to cool down the light source naturally by contact with external air, which may result in deterioration of the elements. Accordingly, there has been suggested a structure in which heat from a light source and a housing is forcedly discharged using a forcing air flow generated by a fan motor (refer to Patent Literature 2, for example). However, according to the suggested forced cooling method, heat is discharged through an air flow path provided in the light source and thus dust and foreign objects are likely to enter the flow path. For example, the device may cause an accident such as firing if any flammable object contacts the light source, or the device may decrease in luminous efficiency or the like if dust or the like adheres to and accumulates on the internal surface of a lens unit.

CITATION LIST

Patent Literatures

Patent Document 1: JP 2011-108590 A
Patent Document 2: JP 2010-86713 A

SUMMARY OF INVENTION

Technical Problem

In light of the foregoing circumstances, an object of the present invention is to provide a lighting device that allows efficient heat discharge from a light source while avoiding accidents such as firing due to a flammable foreign object in contact with the light source or the like and failures such as reduction in luminous efficiency due to dust or the like adhered to and accumulated on the internal surface of a lens unit.

Solution to Problem

To solve the foregoing problem, the present invention provides a lighting device having a lens unit covering a light source at a leading end side thereof, wherein the light source is supported on a leading end-side surface of a light source support stand formed by a high heat-conductive member, the light source is stored in an approximately sealed state by the light source support stand and the lens unit, air inlets/outlets are provided on a wall surface of a housing nearer a base end side than the light source support stand, and heat generated at the light source is discharged by an air flow generated inside and outside the housing through the air inlets/outlets, from the base end-side surface of the light source support stand to the outside of the housing.

In this arrangement, it is preferred to provide a heat sink member formed by a high heat-conductive member in a protruding state on the base end-side surface of the light source support stand, thereby to discharge heat generated at the light source by the air flow from the base end-side surface of the light source support stand and the heat sink member to the outside of the hosing.

Specifically, it is preferred to provide the heat sink member with a plate-like support part fixed to the light source support stand and a plurality of fins provided in a protruding state on a surface of the support part opposite to the surface fixed to the light source support stand, and to form the fins by pressing and folding a part of a plate-like base material of high heat-conductive metal toward the opposite side, and set the remaining part of the plate-like base material with the fins as the support part.

In this arrangement, it is preferred to form the plurality of fins by providing a plurality of plate-like fin parts in a protruding state on an outer peripheral part of the plate-like base material, and pressing and folding the plurality of plate-like fin parts at a predetermined angle and raising the same toward the opposite side at the protruding base-end part or near the same so as not to interfere with each other.

It is further preferred to form the plate-like fin parts so as to protrude obliquely at a predetermined angle with respect to a radial direction of the plate-like base material.

It is also preferred to set the heat sink member as a first heat sink, and overlap and fix a second heat sink that includes a plate-like support part and a plurality of fins and is approximately similar in shape to the first heat sink and smaller in size than the first heat sink, on a surface of the first heat sink opposite to the surface on which the support part is fixed to the light source support stand.

It is also preferred to provide the heat sink member with a plate-like support part fixed to the light source support stand and a plurality of fins provided in a protruding state on a surface of the support part opposite to the surface fixed to the light source support stand, and shape the fins into void or solid columnar bodies of high heat-conductive metal, and swage and fix the columnar bodies to a plate-like base material of high heat-conductive metal constituting the support part, thereby to raise the columnar bodies on the opposite side surface. In particular, it is preferred to raise the columnar bodies on the plate-like base material by pressing the plate-like base material to swage and fix the columnar bodies.

In this arrangement, it is preferred to provide the plate-like base material with attachment holes for inserting and fixing the columnar bodies, and perform a burring process on the attachment holes to form thick-walled portions along inner peripheral edges of the attachment holes, and compress the thick-walled portions in an axial direction while the columnar bodies are inserted into the attachment holes, thereby to deform the thick-walled portions plastically toward centers of the attachment holes and attach the thick-walled portions under pressure onto outer peripheral surfaces of the columnar bodies, whereby the columnar bodies are swaged and fixed.

It is further preferred to provide the plate-like base material with attachment holes for inserting and fixing the columnar bodies, and form step parts on entire or partial peripheries of the attachment holes, and compress the step parts in an axial direction while the columnar bodies are inserted into the attachment holes, thereby to deform the step parts plastically toward centers of the attachment holes and attach inner peripheral parts of the attachment holes under pressure onto outer peripheral surfaces of the columnar bodies, whereby the columnar bodies are swaged and fixed.

It is also preferred to provide the heat sink member with a plate-like support part fixed to the light source support stand and a plurality of fins provided in a protruding state on a surface of the support part opposite to the surface fixed to the light source support stand and shape the fins into bending plate bodies by pressing and bending a plate-like base material of high heat-conductive metal, and fix the bending plate bodies to the opposite surface of the plate-like base material of high heat-conductive metal constituting the support part.

In this arrangement, it is preferred to fix first lateral end surfaces of extended bending parts in the bending plate bodies to the opposite side surface of the plate-like base material constituting the support part, thereby to extend the bending parts along a direction of protrusion of the bending plate bodies. It is also preferred to shape the bending plate bodies into corrugated plates by pressing and bending the plate-like base material so as to have a plurality of bends.

It is also preferred to provide the heat sink member with a plate-like support part fixed to the light source support stand and a plurality of fins provided in a protruding state on a surface of the support part opposite to the surface fixed to the light source support stand, and shape the fins into plate-like solid columnar bodies of high heat-conductive metal, and raise the columnar bodies in a radial or an approximately radial fashion on the opposite surface of a plate-like base material of high heat-conductive metal constituting the support part. In this arrangement, it is preferred to provide the plate-like base material with attachment holes for inserting and fixing the columnar bodies, and form step parts on entire or partial peripheries of the attachment holes, and compress the step parts in an axial direction while the columnar bodies are inserted into the attachment holes, thereby to deform the step parts plastically toward centers of the attachment holes and attach the inner peripheral parts of the attachment holes under pressure onto outer peripheral surfaces of the columnar bodies, whereby the columnar bodies are swaged and fixed. The "radial fashion" here refers to the state where the plate-like columnar bodies are raised outward from the center of the support part, and the "approximately radial fashion" here refers to the state where the columnar bodies are raised along a line forming a predetermined angle with respect to the center of the support part and not passing through the center of the support part.

It is also preferred to arrange a fan motor in the housing and discharge heat generated at the light source to the outside of the housing from the base end-side surface of the light source support stand, by a forcing air flow generated by the fan motor inside and outside of the housing through the air inlets/outlets.

It is also preferred to form the housing by a first case connected at a leading end part thereof to the light source support stand and a second case having a cap at a base end part thereof, and provide the first and second cases with the air inlets/outlets at side wall parts thereof. It is particularly preferred to form the first case by a high heat-conductive member.

It is further preferred to provide the first case with a plurality of axially extending fins in a protruding state on an inner peripheral surface of a cylindrical case main unit, and a plurality of axially extending penetration grooves along the fins, and make the penetration grooves function as the air inlets/outlets. It is particularly preferred to form the plurality of fins by arranging a plurality of pairs of fins in a peripheral direction so as to protrude in an upturned trumpet shape in a cross-section view.

It is also preferred to form the first case by pressing a plate material, and to form the first case by assembling together two or three or more divided cases of the same structure.

It is also preferred to interpose a lens fixing member formed by a high heat-conductive member between the lens unit and the light source support stand, so as to be exposed on an outer surface, and store the light source in an approximately sealed state by the light source support stand, the lens fixing member, and the lens unit.

It is particularly preferred to form the lens fixing member in a drawing-processed cylindrical shape with a bottom surface, and expose an outer surface of the cylindrical part to the outside, and attach the base end part of the lens unit to an inner surface of the cylindrical part, and fix the bottom surface of the cylindrical part to the light source support stand.

It is also preferred to include a power circuit part in the housing, and discharge heat generated at the power circuit part to the outside of the housing by a forcing air flow generated by the fan motor.

In this arrangement, it is preferred to connect the power circuit part by a plurality of pillar members to the base end-side surface of the light source support stand. It is particularly preferred to make the pillar members penetrate a support plate that has an opening at a central part thereof and supports the fan motor so as to close the opening, and to fix the penetrated parts by swaging or the like, whereby the power circuit part is fixed to the penetrated base end-side surface of the support plate.

Advantageous Effects of Invention

The foregoing lighting device according to the invention of the subject application realizes efficient discharge of heat from the housing to the outside by an air flow. In addition, in the lighting device, heat generated at the light source is not discharged by a path for the air flow but is transferred to the light source support stand as a high heat-conductive material and is efficiently discharged from the base end-side surface of the light source support stand by the air flow, while the light source is stored in an approximately sealed state by the light source support stand and the lens unit to prevent entry of foreign objects and avoid accidents such as firing due to flammable foreign objects in contact with the light source and failures such as reduction in luminous efficiency due to dust or the like attached to and accumulated on the inner surface of the lens unit.

Specifically, in the lighting device of the present invention, heat from the storage space of the light source is not directly discharged by the air flow but the storage space remains in an approximately sealed state to prevent entry of foreign objects and the light source support stand of a high heat-conductive member functions as a heat sink to discharge heat indirectly by the air flow. Accordingly, it is possible to maintain stable performance of the light source for a long period of time while avoiding adverse effects of dust and heat.

The heat sink member formed by a high heat-conductive member is provided in a protruding state on the base end-side surface of the light source support stand, and heat generated at the light source is discharged to the outside of the housing by an air flow from the base end-side surface of the light source support stand and the heat sink member. Accordingly, it is possible to allow both the light source support stand and the heat sink member to function as heat sinks and obtain higher cooling performance.

The heat sink member includes the support part and the fins formed by pressing a plate-like base material of high heat-conductive metal. Accordingly, it is possible to produce the more lightweight heat sink member at lower material and processing costs as compared to conventional aluminum die-casting heat sinks, and support complicated fin shapes and increase easily the surface area of the fins to provide higher cooling performance.

The heat sink member has the plurality of plate-like fin parts formed in a protruding state at the outer peripheral part of the plate-like base material, and the plurality of plate-like fin parts has the plurality of fins formed by folding and raising the plate-like fin parts at a predetermined angle toward the opposite side at protruding base end parts or near the same so as not to interfere with each other. Accordingly, it is possible to process easily the heat sink member at reduced costs and allow air to flow between the raised plate-like fins to discharge efficiently heat from the surfaces of the plate-like fins and the support part.

The heat sink member has the plate-like fin parts formed so as to protrude obliquely at a predetermined angle with respect to the radial direction of the plate-like base material. Accordingly, if the plate-like fins of the present invention identical in number and area to conventional plate-like fins extended straight in a radial direction, are prepared from the plate-like base material of the present invention identical in area to conventional plate-like base materials, it is possible to make the support part larger in area than the conventional ones. In addition, if the support part of the present invention is identical in area to the conventional ones, it is possible to make the plate-like fins of the present invention larger in area and width than the conventional ones, and thus make the plate-like fins of the present invention larger in cross-section area than the conventional ones. This enhances the characteristics of heat transfer from the support part to the plate-like fins, and further improves the characteristics of heat discharge from the entire device. Since the plate-like base material can be further efficiently used, it is possible to reduce the size of the plate-like base material required for the plate-like fins and the support part with the same size and decrease material costs as compared to conventional ones. That is, the present invention can produce larger heat-dissipation effect at the same material costs as those in conventional cases, and reduce material costs with the same heat-dissipation effect as that in conventional cases. These combinations can be selected as appropriate in accordance with required heat-dissipation properties and the like.

The foregoing heat sink member is set as the first heat sink, and the second heat sink that includes a plate-like support part and a plurality of fins and is approximately similar in shape to the first heat sink and smaller in size than the first heat sink, is overlapped and fixed on the surface of the first heat sink opposite to the surface on which the support part is fixed to the light source support stand. Accordingly, heat received by the first heat sink at the entire surface of the support part from the light source support stand can be dissipated by the plurality of fins of the first heat sink, and the heat can also be transferred from the support part of the first heat sink to the support part of the second heat sink and released from the plurality of fins of the second heat sink. Therefore, it is possible to increase the number of fins simply by overlapping the two heat sinks, thereby to provide the heat sinks with excellent heat-dissipation effect at low costs. In addition, an air flow path is formed not only between adjacent fins in each of the heat sinks but also between adjacent fins across the heat sinks. It is therefore possible to form the air flow path around all the fins to realize further effective heat dissipation. The second heat sink may be arranged in any form, for example, may have a smaller number of fins depending on required heat-dissipation properties and the like, as far as the second heat sink can be placed within the support part of the first heat sink, but preferably, the second heat sink is similar in shape to the first heat sink for further higher heat-dissipation effect.

The heat sink member includes the plate-like support part fixed to the light source support stand and the plurality of fins provided in a protruding state on the surface of the support part opposite to the surface fixed to the light source support stand, and the fins are shaped into void or solid columnar bodies of high heat-conductive metal, and the columnar bodies are swaged and fixed to the plate-like base material of a high heat-conductive metal constituting the support part by pressing the plate-like base material, thereby to raise the columnar bodies on the opposite side surface. Accordingly, it is possible to swage and raise the columnar bodies as fins on the plate-like base material of high heat-conductive metal by pressing the plate-like base material. Therefore, it is possible to produce the more lightweight heat sink member at lower material and processing costs as compared to conventional aluminum die-casting heat sinks, and increase easily the surface area of the fins to provide higher cooling performance. Further, the fins can be enhanced in strength and expanded in application as compared to plate-like bending fins. In addition, air flowing between the columnar fins faces less resistance than air flowing between plate-like fins, which makes it possible to improve air distribution and enhance cooling performance by heat dissipation.

The heat sink member includes the plate-like base material having the attachment holes for inserting and fixing the columnar bodies, and the attachment holes have the thick-walled portions formed by a burring process along the inner peripheral edges thereof, and the thick-walled portions are compressed in the axial direction while the columnar bodies are inserted into the attachment holes, and the thick-walled portions are plastically deformed toward the centers of the attachment holes to attach the thick-walled portions under pressure onto outer peripheral surfaces of the columnar bodies, whereby the columnar bodies can be raised in an easy manner and at low costs.

The heat sink member has the attachment holes for inserting and fixing the columnar bodies to the plate-like base material, and the step parts formed on the entire or partial peripheries of the attachment hole, and the step parts are compressed in the axial direction while the columnar bodies are inserted into the attachment holes, and the step parts are plastically deformed toward the centers of the attachment holes to attach the inner peripheral parts of the attachment holes to the outer peripheral surfaces of the columnar bodies, whereby the columnar bodies can be raised in an easy manner and at low costs. Specifically, it is possible to assemble the columnar bodies having an outer shape narrower than the attachment holes, and swage and fix the columnar bodies having an outer shape with a limit press hole diameter (for example, φ 0.6 mm) or smaller. In particular, this arrangement is effective in assembling thin plate-like columnar bodies.

The heat sink member includes the plate-like support part fixed to the light source support stand and the fins provided in a protruding state on the surface of the support part opposite to the surface fixed to the light source support stand, and the fins are shaped into bending plate bodies by pressing and bending a plate-like base material of high heat-conductive metal, and the bending plate bodies are fixed to the opposite surface of the plate-like base material of high heat-conductive metal constituting the support part. Accordingly, it is possible to produce the more lightweight heat sink member at lower material and processing costs as compared to conventional aluminum die-casting heat sinks, and support complicated fin shapes and increase easily the surface area of the fins to provide higher cooling performance. Further, since the separately pressed and bent plate bodies are fixed to the support part, it is possible to increase the degree of freedom in the design of the fin shape and the like, and arrange the fins more closely. This increases the surface area of the fins to improve heat-dissipation properties.

The bending parts of the bending plate bodies have first lateral end surfaces fixed to the opposite surface of the plate-like base material constituting the support part, and thus the bending parts extend along the direction of protrusion of the bending plate bodies. Accordingly, the heat sink is extremely excellent in fin strength. In addition, the bending plate bodies have a plurality of bends like corrugated plates formed by pressing the plate-like base material, which makes it possible to further increase a heat-release area of the fins and thus produce the heat sink with excellent heat-dissipation properties.

The heat sink includes the plate-like support part fixed to the light source support stand and the plurality of fins provided in a protruding state on the surface of the support part opposite to the surface fixed to the light source support stand, and the fins are shaped into plate-like solid columnar bodies of high heat-conductive metal, and the columnar bodies are raised in a radial or an approximately radial fashion on the opposite surface of the plate-like base material of high heat-conductive metal constituting the support part. Accordingly, it is possible to produce the more lightweight heat sink at lower material and processing costs as compared to conventional aluminum die-casting heat sinks, and support complicated fin shapes and increase easily the surface area of the fins to provide higher cooling performance.

The provision of the fan motor in the housing makes it possible to efficiently discharge heat to the outside from the housing by a forcing air flow.

The housing includes the first case connected at the leading end part thereof to the light source support stand and the second case having the cap at the base end part thereof, and the first and second cases are each provided with the air inlets/outlets at the side wall parts thereof. The blocked cases can be easily assembled, and in-housing components and others can also be easily attached to the housing, whereby the device can be efficiently produced.

The size of the first case connected to the light source support stand can be determined depending on the size of the light source support stand adapted to the size of the light source, and thus the first case has no waste space. This allows downsizing of the entire device including the second case. In addition, it is possible to form a smooth forcing air flow inside the housing by placing the fan motor between the air inlets/outlets of the first case and the air inlets/outlets of the second case, for example, thereby to smoothly dissipate heat from the light source and the in-housing components to the outside of the housing without interruption.

The first case is formed by a high heat-conductive member, and thus the first case performs a heat sink function to discharge heat from the light source transferred via the light source support stand into an air flow contacting the inner surface of the case and an external air contacting the outer surface of the case, thereby producing further enhanced cooling effect. In addition, it is also possible to decrease heat transferred from the light source support stand to the lens unit and reduce heat stress on the connection part of the lens unit at the base end side, thereby resulting in increased reliability of the device.

The first case has a plurality of axially extending fins provided in a protruding state on the inner peripheral surface of the cylindrical case main unit and has a plurality of axially extending penetration grooves along the fins, and the penetration grooves function as the air inlets/outlets. Accordingly, it is possible to provide the first case with the air inlets/outlets while allowing the fins to act as ribs to maintain the strength of the first case. In addition, the fins do not expose to the outside, and thus are safe without causing a fear of contact with the user's hand and fingers, and do not have any harmful effect on the appearance of the device. In particular, if the first case is formed by a high heat-conductive member, the fins can be increased in surface area to enhance the cooling functionality of the first case as a heat sink.

The plurality of fins has the plurality of pairs of fins protruding circumferentially in the shape of an upturned trumpet in a cross-section view, and thus it is possible to form a large number of fins and air inlets/outlets in an efficient manner. In addition, the penetration grooves as air inlets/outlets are formed at the gaps between the fins extending obliquely in the shape of an upturned trumpet and the case main unit, and thus it is possible to prevent entry of foreign objects through the penetration grooves, in a safe and reliable manner.

The first case is formed by pressing a plate material, and thus it is possible to process a thin plate to produce a more lightweight case from a smaller amount of material at low prices with excellent workability. In particular, it is possible to produce the fins and the penetration grooves efficiently at the same time.

The first case is formed by assembling together two or three or more divided cases of the same structure, and thus it is possible to shape easily the divided cases using a single mold when pressing due to the same structure. The divided cases can be produced at high accuracy and easily assembled with excellent productivity and efficiency.

The lens fixing member as a high heat-conductive member is interposed between the lens unit and the light source support stand so as to be exposed on the outer surface, and the light source is stored in an approximately sealed state by the light source support stand, the lens fixing member, and the lens unit. Accordingly, it is possible to obtain the effect of cooling the light source, decrease heat transferred to the lens unit, and reduce heat stress on the connection part of the lens unit at the base end side thereof, thereby resulting in higher reliability.

The lens fixing member is formed in a drawing-processed cylindrical shape with a bottom surface, and the outer surface of the cylindrical part is exposed to the outside, and the base end part of the lens unit is attached to the inner surface of the cylindrical part, and the bottom surface of the cylindrical part is fixed to the light source support stand. Accordingly, the attachment section of the base end part of the lens unit is invisible to improve the appearance of the device, and the base end part is protected by the cylindrical part to prevent damage of the lens unit, thereby resulting in higher reliability. In addition, since the bottom surface part of the lens fixing member is fixed to the light source support stand, it is possible to increase the effect of cooling the light source and reduce heat stress on the lens unit, thereby resulting in higher reliability.

The power circuit part is arranged in the housing such that heat generated at the power circuit part can be discharged to the outside of the housing by a forcing air flow generated by the fan motor.

The power circuit part is connected by a plurality of pillar members to the base end-side surface of the light source support stand, and thus it is possible to fix the two components in a stable manner and assemble the two components in an easy manner. In addition, an air flow required for cooling is less inhibited.

The plurality of pillar members penetrate the support plate that has an opening at the central part thereof and supports the fan motor so as to close the opening, and the penetrated sections are fixed by swaging or the like, thereby to fix the power circuit part to the penetrated base end-side surface of the support plate. This makes it possible to maintain strength and realize easy assembly.

BRIEF DESCRIPTION OF DRAWINGS

FIG. 1 is a side view of a lighting device according to a first embodiment of the present invention;

FIG. 2 is a vertical cross-section view of an internal structure of the lighting device;

FIG. 3 is a simplified cross-section view of an internal wiring structure of the lighting device;

FIG. 4 is an exploded perspective view of the lighting device;

FIG. 5 is an exploded perspective view of major components of the lighting device;

FIG. 6 is a cross-section view of major components in the internal structure of the lighting device;

FIG. 7 is an illustration diagram showing that a penetration part of a pillar member is swaged and fixed to a support plate;

FIG. 8 is an illustration diagram showing the opened state of a larger heat sink member before a bending process;

FIG. 9 is an illustration diagram showing that the larger heat sink member is attached to a light source support stand;

FIG. 10 is an illustration diagram showing the opened state of a smaller heat sink member before a bending process;

FIG. 11 is a cross-section view of the larger and smaller heat sink members attached to the light source support stand;

FIG. 12 is a perspective view of the larger and smaller heat sink members attached to the light source support stand;

FIG. 13 is a side view of a divided case constituting a first case;

FIG. 14 is a perspective view of the divided case;

FIG. 15 is a lateral cross-section view of the divided case;

FIG. 16 is a cross-section view of major components of the divided case;

FIG. 17 is a cross-section view of major components of a modification example of the lighting device;

FIG. 18 is a cross-section view of major components of another modification example of the lighting device;

FIG. 19 (*a*) is a side view of a modification example of a second case, and FIG. 19 (*b*) is a partially damaged perspective view of the modification example of the second case;

FIGS. 20 (*a*) and 20 (*b*) are illustration diagrams of another modification example of the second case;

FIG. 21 is an illustration diagram of a modification example of the lighting device with an adapter connected to a cap;

FIGS. 22 (*a*) and 22 (*b*) are illustration diagrams of still another modification example of the lighting device;

FIGS. 23 (*a*) and 23 (*b*) are illustration diagrams of a modification example of the heat sink member;

FIG. 24 (*a*) is a side view of a lighting device according to a second embodiment, and FIG. 24 (*b*) is a perspective view of a heat sink member according to the second embodiment;

FIG. 25 is a perspective view of a heat sink member according to a third embodiment;

FIG. 26 is a perspective view of a modification example of the heat sink member according to the third embodiment;

FIG. 27 is a perspective view of a heat sink member according to a fourth embodiment;

FIG. 28 is a cross-section view of a modification example of columnar bodies of the heat sink member according to the fourth embodiment;

FIG. 29 (*a*) is a plane view of the heat sink member, and FIGS. 29 (*b*) and 29 (*c*) are illustration diagrams showing a method for swaging and fixing the columnar bodies to the support part;

FIG. 30 (*a*) is a plane view of a modification example of the heat sink member, and FIGS. 30 (*b*) and 30 (*c*) are illustration diagrams showing a method for swaging and fixing the columnar bodies to the support part; and FIG. 31 (*a*) is a plane view of another modification example of the heat sink member, and FIGS. 31 (*b*) to 31 (*f*) are illustration diagrams showing a method for swaging and fixing the columnar bodies to the support part.

DESCRIPTION OF EMBODIMENTS

Next, embodiments of the present invention will be described in detail with reference to the attached drawings. Firstly, a first embodiment will be described with reference to FIGS. 1 to 23.

A lighting device 1 of the present invention has a lens unit 21 covering a light source 20 at a leading end side thereof, as shown in FIGS. 1 to 4. In this example, the lighting device 1 is configured as a bulb (in particular, a large-sized mercury lamp) having at a base end side thereof a cap 40 connected to an external power source. However, the present invention is not limited to this but is also applicable to lighting devices other than bulbs. In this example, the lighting device 1 contains a fan motor to apply a forcing air flow to an internal heat sink for heat dissipation. Alternatively, the fan motor may be omitted such that heat is dissipated by a natural air flow (resulting from natural air inflow/outflow through air inlets/outlets).

The lighting device 1 has the light source 20 supported on a leading end-side surface 22*a* of a light source support stand 22 formed by a high heat-conductive member such as aluminum. The light source 20 is stored in an approximately sealed state by the light source support stand 22 and the lens unit 21. The approximately sealed state here refers to a structure in which there is no positive ventilation hole or clearance communicating with the internal space of the housing and the outside of the housing. In such a structure, the housing may be sealed by rubber seal in an approximately complete manner, or the housing may have no rubber seal and thus have slight gaps between screw holes and screws, between lock pawls and lock grooves, and between wire holes and wires, and the like.

The housing 50 has air inlets/outlets 51 and 52 on a wall surface thereof nearer the base end side than the light source support stand 22, and the housing 50 has a fan motor 10 therein. The fan motor 10 generates a forcing air flow inside and outside the housing 50 through the air inlets/outlets 51 and 52, such that heat generated at the light source 20 is discharged by the forcing air flow from the base end-side surface 22*b* of the light source support stand 22 to the outside of the housing 50. The foregoing structure makes it possible to store the light source 20 in the approximately sealed state by the light source support stand 22 and the lens unit 21 to prevent entry of foreign objects, and transfer heat generated at the light source 20 to the light source support stand 22 as a high heat-conductive member, and discharge the heat by the forcing air flow from the base end-side surface 22*b* of the light source support stand 22 to the outside of the housing, thereby efficiently cooling the light source in the approximately sealed state.

The light source 20 may use an LED module, or may use any of a wide variety of publicly-known conventional light sources for lighting devices, such as fluorescent lamps, halogen lamps including filaments, and high-brightness electric-discharge lamps (high-pressure sodium lamps, metal halide lamps (multi-halogen lamps), mercury lamps, and the like). In addition, the lens unit may be any of publicly-known conventional lens units.

In this example, a lens fixing member 23 formed by a high heat-conductive member such as aluminum is interposed between the lens unit 21 and the light source support stand 22 such that an outer surface of the lens fixing member 23 is exposed to the outside, and the light source 20 is stored in the approximately sealed state by the light source supporting stand 22, the lens fixing member 23, and the lens unit 21. The lens fixing member 23 is formed in the shape of a drawing-processed cylinder having a bottom surface as shown in FIG. 5. A bottom surface part 23*b* has an opening 23*c* through which the light source 20 fixed to the light source support stand 22 is escaped and protruded toward the leading end side without being caught in the lens fixing member 23, and has a through hole 23*f* through which a wire is passed to the light source 20.

The lens fixing member 23 has, around the opening 23*c* thereof, through holes 23*d* through which attachment screws 70 are passed and fastened into screw holes 22*c* formed at corresponding positions on the leading end-side surface 22*a* of the light source support stand 22, thereby to fix the bottom surface part 23*b* to the light source support stand 22. Further, the lens fixing member 23 has, at predetermined positions near a rising section of the cylindrical part 23*a*, engagement grooves 23*e* for engagement with pawls 21*b* protruding from the base end part 21*c* of the lens unit 21.

After the lens fixing member 23 is attached to the light source support stand 22 by the attachment screws 70, the lens unit base end part 21*c* is inserted into an inner surface side of the cylindrical part 23*a* of the lens fixing member 23 as shown in FIG. 4, and the pawls 21*b* are engaged with the engagement grooves 23*e*, and an adhesive or a water-proof packing or the like is applied as necessary between an outer surface of the base end part 21*c* and an inner surface of the cylindrical part 23*a*, thereby to attach the lens unit 21 to the light source support stand 22 via the lens fixing member 23. In the attached state, since the outer surface of the cylindrical part 23*a* is exposed to the outside, the attachment portion of the lens unit base end part 21*c* becomes invisible to improve the appearance of the device and the lens unit base end part 21*c* can be protected and prevented from breakage. In addition, since heat from the light source is discharged by the cylindrical part 23*a* exposed to the outside of the lens fixing member 23, it is also possible to prevent heat stress on the lens.

The lens fixing member 23 may not be necessarily provided but the lens unit 21 may be attached directly to the light source support stand 22. In this case, it is preferred to form a cylindrical part similar to the cylindrical part 23*a* of the lens fixing member 23 on the light source support stand 22 to produce breakage prevention effect and heat stress prevention effect as described above.

The light source support stand 22, as shown in FIG. 5, includes a disc part 24 of the same outer shape as that of the bottom surface part 23*b* of the lens fixing member 23, and a bracket part 25 extending cylindrically from an outer periphery of the disc part 24 toward the base end side. The disc part 24 has screw holes 24*a* through which attachment screws 71 are fastened for attachment of the light source 20, screw holes 22*c* through which the attachment screws 70 are fastened for attachment of the lens fixing member 23, a through hole 24*b* that corresponds to and communicates with the through hole 23*f* in the lens fixing member 23 for passing the wire from the light source 20, penetration holes 24*c* through which pillar members 12 of a power circuit part 6 described later are passed and fixed to the lens fixing member 23 by attachment screws 72, and avoidance grooves 24*d* that correspond to the engagement grooves 23*e* of the lens fixing member 23 to avoid leading end parts of the pawls 21*b* of the lens unit 21 engaged with the engagement grooves 23*e*.

A heat sink member 11 formed by a high heat-conductive member such as aluminum, is provided in a protruding state on the base end-side surface of the disc part 24, that is, on the base end-side surface 22*b* of the light source support stand 22, as shown in FIGS. 11 and 12. The provision of the heat sink member 11 allows both the light source support stand 22 and the heat sink member 11 to function as heat sinks contacting a forcing air flow in the housing 50, thereby producing a higher effect of cooling the light source. In addition, the bracket part 25 has, corresponding to corners at leading ends of joint sides of divided cases 3A and 3B described later, screw holes 25*a* for attachment of the corners by attachment screws 73, and engagement grooves 25*b* that receive and engage with both bending portions 30*a* and 30*a* of the divided cases 3A and 3B formed on the joint sides.

The heat sink member 11 includes two larger and smaller similar-shaped members (11A and 11B), each of the members has a plate-like support part 11*b* and a plurality of plate-like fins 11*a* . . . integrally formed by a bending process on an outer periphery of the plate-like support part 11*b*, and the support parts 11*b* of the two members 11A and 11B are overlapped and axially attached at centers thereof aligned to the base end-side surface 22*b* of the light source support stand. Specifically, as shown in FIG. 8 or 10, each of the heat sink members 11A and 11B is configured such that a plurality of plate-like fin parts 11*c* is formed in a flat plate shape from a plate of metal such as aluminum so as to extend obliquely at a predetermined angle with respect to the radial direction from the support part 11*b* and the outer periphery thereof, and then the plate-like fin parts 11*c* are axially folded and raised from the root section by a bending process so as not to interfere with one another, thereby configuring the plate-like fins 11*a*.

In the thus configured heat sink members 11A and 11B, the entire support parts 11*b* abut the base end-side surface 22*b* of the light source support stand 22, and the entire support parts 11*b* and 11*b* abut each other to receive heat in an efficient manner, and the plate-like fins 11*a* are raised toward the base end side to discharge heat efficiently from the surfaces of the plate-like fins 11*a*. In particular, since the two larger and smaller members 11A and 11B are attached in an overlapping state, a path for a forcing air flow is formed between the plate-like fins 11*a* and 11*a* circumferentially adjacent to each other in each of the members to discharge efficiently heat transferred to the plate-like fins 11*a*. In addition, the air flow path is also formed between the plate-like fins 11*a* and 11*a* radially adjacent to each other across the heat sink members 11A and 11B. Accordingly, the path for a forcing air flow can be formed around all the plate-like fins 11*a*, thereby achieving further efficient heat discharge. Further, the centers of the heat sink members 11A and 11B are approximately identical to the center of a light emitting part of the light source 20, and thus heat generated from the light source 20 can be transferred to the heat sink members 11A and 11B in an approximately direct manner via the light source support stand 22, thereby resulting in enhanced heat-dissipation efficiency.

In this example, the plate-like fin parts 11*c* constituting the plate-like fins 11*a* of the heat sink members 11A and 11B extend obliquely at a predetermined angle with respect to the radial direction of the support parts 11*b*. Accordingly, if the plate-like fins of the present invention identical in number and area to conventional plate-like fins extended straight in a radial direction, are prepared from the plate-like base material of the present invention identical in area to a conventional plate-like base material, it is possible to make the support parts 11*b* larger in area than the conventional ones, make the plate-like fins of the present invention larger in width than the conventional ones, and thus make the plate-like fins of the present invention larger in cross-section area than the conventional ones. This enhances the characteristics of heat transfer from the support part to the plate-like fins, and further improves the characteristics of heat discharge from the entire device. In addition, since the plate-like base material can be used more efficiently, it is possible to reduce the size of the plate-like base material required for the plate-like fins and the support parts as compared to the conventional one, thereby bringing about reduction in material costs.

In this example, the two heat sink members 11A and 11B are overlapped as described above. Alternatively, three or more heat sink members can be overlapped, or only one, that is, only the heat sink member 11A may be used. In addition, the heat sink members 11A and 11B have the plate-like fin parts 11*c* formed by a disc-shaped base material so as to extend obliquely at a predetermined angle with respect to the radial direction of the support parts 11*b*. Alternatively, the plate-like fin parts 11*c* may be extended straight along the radial direction as shown in FIG. 23. In this case, similarly, a single heat sink member may be used, or heat sink members approximately identical in shape and smaller in size may be overlapped. In addition, in this embodiment, the fin parts 11*a* of the heat sink members 11A and 11B are bent to be open radially outward and extended toward the leading end side. However, the fin parts 11*a* are not limited to this shape but may be formed in any other shape, for example, may be bent so as to be axially oriented at a right angle with respect to the support parts 11*b*. In addition, the number of the fins of the heat sink member 11B may be selected as appropriate depending on requirements of heat dissipation properties, and does not need to be equal to the number of the fins of the heat sink member 11A. For a higher heat-discharge effect, however, the heat sinks are preferably formed in a similar shape as in this embodiment.

In the present invention, the heat sink members 11 is not necessarily essential but may be omitted. In this case, for example as shown in FIG. 22, it is preferred to provide a regulation member 9 including a cylindrical shield wall 90 and a disc-shaped void regulation plate 91 formed on a leading end of the shield wall 90, so as to protrude toward the leading end side from a support plate 13 supporting the fan motor 10, such that the air flow path is configured to allow a forcing air generated by the fan motor 10 to flow as closest to the light source support stand 22 as possible. The regulation member 9 may be formed by a high heat-conductive member such as aluminum to function as a heat sink for the fan motor 10 as with the support plate 13.

The housing 50 includes a first case 3 connected at a leading end part thereof to the light source support stand 22, and a second case 4 provided with a cap 40 at a base end part thereof. The first case 3 and the second case 4 each have the air inlets/outlets 51 and 52 on side walls thereof, as shown in FIGS. 1 to 4. In addition, the fan motor 10 is arranged within the housing 50 between the air inlets/outlets 51 of the first case 3 and the air inlets/outlets 52 of the second case 4 to taken in an external air from the air inlets/outlets 51 or 52 in the direction of rotation of the fan motor 10, and generate a forcing air flow from the air inlets/outlets 52 or 51 within the housing. In this example, the first case 3 includes at a position near a boundary of connection with the second case 4, the support plate 13 formed by a high heat-conductive member such as aluminum and having an opened central part. The fan motor 10 is fixed to the support plate 13 by attachment screws 75 so as to close the opening. The support plate 13 functions as a heat sink for the fan motor 10.

The first case 3 is formed by a high heat-conductive member such as aluminum, and the first case 3 also functions as a heat sink to discharge heat from the light source transferred via the light source support stand into a forcing air flow contacting the inner surface of the case and into an external air contacting the outer surface of the case. More specifically, the first case 3 is formed by assembling together the two divided cases 3A and 3B of the same structure (vertically divided along an axial direction) into a cylindrical shape, and the divided cases are formed by pressing a plate material as shown in FIGS. 13 to 16. Since the divided cases of the same structure are assembled into a cylindrical shape, it is possible to efficiently manufacture the divided cases using the same mold by press processing, die-cast processing or the like, at high accuracy and in an easy assembling operation, thereby resulting in excellent productivity and efficiency. Two divided cases are used in this embodiment, but alternatively three or more divided cases of the same structure may be assembled together. Otherwise, as a matter of the course, such a divided configuration may not be used but one cylindrical case may be integrally configured.

The divided cases 3A and 3B have a plurality of axially extending fins 31, . . . provided in a protruding state on inner peripheral surfaces thereof, and a plurality of axially extending penetration grooves 32, . . . formed along the fins 31. These penetration grooves 32 constitute the air inlets/outlets 51 of the first case 3. More specifically, as shown in FIG. 16, the fins 31, . . . include a plurality of pairs of fins 31 and 31 formed so as to protrude circumferentially in the shape of an upturned trumpet in a cross-section view. The formation of the penetration grooves 32 between the obliquely protruding fins 31 and the case main body prevents entry of foreign objects and the like.

In addition, the power circuit part 6 is arranged between the air inlets/outlets 51 and the air inlets/outlets 52 in the housing 50, and hence heat generated from the power circuit part 6 can be discharged to the outside of the housing 50 by a forcing air flow generated by the fan motor 10. In this embodiment, the power circuit part 6 is formed by placing an annular plate-like circuit board 61 with an opened central part into a void circular-ring resin case 60 with an opened central part, as shown in FIG. 4. The resin case 60 includes a leading end-side case main body 60A and a base end-side cover body 60B which are assembled together by attachment screws 76. Since the case main body 60A is connected by the pillar members 12 to the base end-side surface of the light source support stand 22, the power circuit part 6 is arranged in the second case 4 at a position near a boundary of connection with the first case 3, as shown in the cross-section view of FIG. 6.

The pillar members 12 penetrate the support plate 13 of the fan motor 10 and the penetration parts of the pillar members 12 are fixed by swaging or the like, whereby the power circuit part 6 is fixed to end surfaces of the penetration parts on the leading end side. In a preferably efficient method for swaging, the support plate 13 is provided with penetration holes and circumferences of the penetration holes are made thick-walled by a burring process, and the thick-walled portions are axially compressed and attached to the pillar members 12, for example as shown in FIG. 7. As seen from FIG. 6, the leading end-side parts of the pillar members 12 are passed through the penetration holes 24*c* of the light source support stand 22 and are brought into contact with the lens fixing member 23, and then the leading end-side parts of the pillar members 12 are fixed to the lens fixing member 23 by passing the attachment screws 72 toward the base end side through the corresponding through holes 23*g* in the lens fixing member 23, and then inserting and tightening the attachment screws 72 into screw holes 12*a* on the end surfaces of the pillar members 12. In addition, the base end-side parts of the pillar members 12 are brought into contact with the case main body 60A of the resin case 60 of the power circuit part 6, and then the base end-side parts of the pillar members 12 are fixed to the case main body 60A by passing attachment screws 77 toward the leading end side through the corresponding through holes 60*a* in the case main body 60A, and inserting and tightening the attachment screws 77 into screw holes 12*b* on the end surfaces of the pillar members 12. Material for the pillar members 12 can be selected as appropriate, such that an insulating material such as synthetic resin may be used if insulation is needed, or a high heat-conductive metal material such as aluminum may be used to enhance heat-dissipation properties if no insulation is needed.

In this embodiment, the fan motor 10 and the power circuit part 6 are structured so as to be supported by the pillar members 12 as described above, and the power circuit part 6 is not fixed directly to the second case 4. However, the present invention is not limited to this structure but in a preferred example, the power circuit part 6 may fixed directly to the second case 4 as shown in FIGS. 17 and 18, for example. In the example of FIG. 17, attachment screws 78 are passed toward the leading end side through attachment through holes 44 in the second case 4, and are further passed through the power circuit part 6, and then are inserted and tightened into the screw holes 12*b* on the base end-side end surfaces of the pillar members 12. In this embodiment, the attachment screws 78 act as both screws for assembling the resin case of the power circuit part 6 and screws for fixing the power circuit part 6 to the pillar members 12, thereby resulting in a reduced parts count. In addition, the support plate 13 supporting the fan motor 10 is omitted and thus the fan motor 10 is fixed directly to the leading end-side surface of the case main body 60A. The omission of the support plate 13 eliminates the need for wire hole processing, isolation bushing, and the like. In the example of FIG. 18, the power circuit part 6 is also fixed directly to the second case 4 and further the pillar members 12 are omitted.

The second case 4 is an insulating synthetic resin molded article, and includes an approximately dome-shaped leading end-side case part 4A with a diameter continuously reduced from a leading end opening toward the base end side, and an approximately cylindrical base end-side case part 4B that continuously extends from the leading end-side case part 4A toward the base end side and is reduced in diameter in the middle with a single or a plurality of steps and has a male screw part 41 for attachment of the cap 40 on an outer periphery of a base end thereof as shown in FIGS. 1 to 4. The leading end-side case part 4A has at a peripheral edge of the opening, in correspondence with corners at the leading ends of the joint sides of the divided cases 3A and 3B as shown in FIG. 4, screw holes 42*a* for attachment of the corners by the attachment screws 74, and engagement grooves 42*b* that receive both bending portions 30*a* and 30*a* of the divided cases 3A and 3B formed on the joint sides.

The divided cases 3A and 3B of the first case 3 have bending portions 30*b* and 30*c* at leading end-side and base end-side edge parts thereof, respectively, as shown in FIG. 6. The bending portions 30*b* are locked in gaps between the light source support stand 22 and the lens fixing member 23 described above. The other bending portions 30*c* are engaged into corresponding engagement grooves 42*c* on the peripheral end part of the opening in the leading end-side case part 4A. The leading end-side case part 4A has a plurality of penetration holes 43, . . . penetrating a wall surface thereof at a position nearer the base end side than a position where the power circuit part 6 is arranged. The penetration holes 43 function as air inlets/outlets 52. An approximately dome-shaped dust-proof net 45 is attached by a fixation piece 46 from inside to the leading end-side case part 4A in a sealed state in an area in which the penetration holes 43 are formed, as shown in FIG. 4. This prevents entry of dust and other foreign objects from the penetration holes 43.

Preferably, the foregoing penetration holes 43 may be formed on the wall surface of the base end-side case part 4B, not on the leading end-side case part 4A. In addition, the penetration holes 43 may be penetration grooves. In a modification example of FIG. 19, a plurality of axially extending penetration grooves 47 is formed at predetermined circumferential intervals on the wall surface of the base end-side case part 4B. In this example, the penetration grooves 47 are especially formed in the shape of a bending crank in a cross-section view to prevent entry of dust and foreign objects, in particular, long or coin-shaped foreign objects, without the need for providing the foregoing dust-proof net.

In a modification example of FIG. 20, a plurality of circumferentially extending penetration grooves 48 is formed at predetermined axial intervals on the wall surface of the base end-side case part 4B. In this example, the penetration grooves 48 are also formed in the shape of a crank in a cross-section view, thereby to prevent entry of long or coin-shaped foreign objects. In this example, two divided cases 4C and 4C of the same structure (vertically divided along an axial direction) are assembled together.

With regard to a wiring structure, as shown in a simplified diagram of FIG. 3, lead wires 80 for power input are arranged from the power circuit part 6 to the cap 40, and lead wires 81 and 82 for power supply are arranged from the power circuit part 6 to the fan motor 10 and the light source 20, respectively. In addition, a temperature sensor 84 is placed on the base end-side surface 22*b* of the light source support stand 22, and a lead wire 83 is arranged to input sensor signals from the temperature sensor 84 to the power circuit part 6.

In addition, the power circuit part includes a control section that, upon receipt of the sensor signals, controls operations of the fan motor 10 and the light source 20. This constitutes a contrivance for operating effectively the fan motor 10 and the light source 20 for a long period of time such that the fan motor 10 is stopped at temperatures lower than a predetermined temperature and an amount of light emitted from the light source 20 is reduced or the light source 20 is turned off at temperatures higher than a predetermined temperature. Insulating bushings for wire protection may be provided as appropriate at wire holes provided in the members of a high heat-conductive material such as aluminum for arrangement of the lead wires 81 to 83.

As shown in FIG. 21, to support sockets of different sizes or lengthen the base end-side case part so as to be suited to deeper socket positions although sockets are of the same size, in a preferred example, an adapter 49 with a separate cap 40A can be attached to the base end-side case part 4B. The adapter 49 is structured such that a lock pawl 49*a* is provided on an inner peripheral surface of an approximately cylindrical synthetic resin main body 49A near a leading end opening and is locked in an engagement groove 88 formed on the outer peripheral surface of the base end-side case part 4B, and contacts 85 and 86 are provided at positions corresponding to the cap 40, and the cap 40A is provided at the base end part. The contact 85 is capable of being pressed and biased to the cap 40 by a coil spring 87.

The engagement groove 88 in the base end-side case part 4B includes: a longitudinal groove 88*a* that receives the lock pawl 49*a* of the adapter 49 from the base end opened to the step part with a reduced diameter in the middle and guides the lock pawl 49*a* toward the leading end side along an axial direction; a lateral groove 88*b* that continuously guides the lock pawl 49*a* in a circumferential direction from a leading end part of the longitudinal groove 88*a*; and a return groove 88*c* that returns from the terminal end of the lateral groove 88*b* toward the axial base end side. In addition, when the lock pawl 49*a* is guided along the engagement groove 88 and attached to the base end-side case part 4B against a biasing force to a direction of separation generated by the coil spring 87 in the adapter 49, the adapter 49 and the base end-side case part 4B can be held stably so as to be incapable of relative rotation at a position where the lock pawl 49*a* is locked in the return groove 88*c*, and the adapter 49 and the base end-side case part 4B can be integrally attached to and removed from the socket.

Next, a second embodiment of the present invention will be described with reference to FIG. 24.

In this embodiment, the heat sink member 11 is attached to the base end-side surface 22*b* of the light source support stand 22, and dissipates heat generated at the light source and transferred from the light source support stand 22, from the outer surfaces thereof into the air within the housing. Instead of providing the plate-like fins 11*a* as in the first embodiment, void or solid columnar bodies 11*d* of a high heat-conductive metal are used as fins. A plate-like base material of high heat-conductive metal constituting the support part 11*b* is pressed to swage and fix the columnar bodies 11*d* to the plate-like base material, whereby the columnar bodies 11*d* are raised on the base end side of the plate-like base material. The swaging and fixing here can be basically performed by the same pressing and swaging method as that for the pillar members 12 and the support plate 13 described above with reference to FIG. 7.

More specifically, the plate-like base material constituting the support part 11*b* includes attachment holes for inserting and fixing the columnar bodies 11*d*, and the attachment holes are subjected to a burring process to form thick-walled portions 11*e* along inner peripheral edges of the attachment holes, and the thick-walled portions 11*e* are compressed from an axial direction while the columnar bodies 11*d* are inserted into the attachment holes such that the thick-walled portions 11*e* are plastically deformed toward centers of the attachment holes and attached to outer peripheral surfaces of the columnar bodies, whereby the columnar bodies 11*d* are swaged and fixed to the support part 11*b*. Besides the foregoing swaging and fixing method, various fixing means can be used, such as gluing, soldering, brazing, other welding techniques, screwing, and pinning.

In this example, the columnar bodies 11*d* are formed in the shape of a void pipe to increase the surface area, but the columnar bodies 11*d* may be solid. In addition, in this example, the columnar bodies 11*d* are formed in the shape of a void pipe penetrating the support part 11*b*, and front and back spaces of the support part 11*b* communicate with each other through the columnar bodies 11*d*. Accordingly, the columnar bodies 11*d* can have chimney effect to distribute air from a high-temperature place to a low-temperature place, which makes it possible to further facilitate a cooling operation. In the structure of this example, however, the columnar bodies 11*d* are attached closely to the surface 22*b* of the light source support stand 22, and thus do not produce the chimney effect due to absence of air distribution. However, the chimney effect can be achieved by adding a modification to the structure. In addition, although not illustrated, when the columnar bodies 11*d* have holes as air inlets on outer walls near root sections thereof, the columnar bodies 11*d* can produce the chimney effect to distribute air inside the columnar bodies 11*d* and facilitate the heat-dissipation effect to dissipate heat from the columnar bodies 11*d* to the outside.

According to this embodiment, the fins are more enhanced in strength than those in the first embodiment, thereby resulting in expanded applications. In addition, when the fins are columnar as in this example, air flowing between the fins faces less resistance as compared to air flowing between the plate-like fins as in the first embodiment, which makes it possible to improve air distribution and enhance cooling performance. In this example, the cross sections of the columnar bodies are circular, but may also be square, oval, or odd-shaped, or others, as a matter of the course.

Next, a third embodiment of the present invention will be described with reference to FIGS. 25 and 26.

In this embodiment, as shown in FIG. 25, the heat sink member 11 is attached to the base end-side surface 22*b* of the light source support stand 22, and dissipates heat generated at the light source and transferred from the light source support stand 22, from the outer surface thereof into the air within the housing. Instead of providing the plate-like fins 11*a* as in the first embodiment, bending plate bodies 11*f* formed by pressing and bending plate-like base materials of high heat-conductive metal are used as fins. The bending plate bodies 11*f* are fixed to a plate-like material of high heat-conductive metal constituting the support part 11*b*. Since the thus separately pressed and bending plate bodies are fixed to the support part, a higher degree of freedom in the design of fin shape and the like can be achieved as compared to the case with that of the heat sink members of the first embodiment. Accordingly, it is possible to arrange the fins more closely and thus increase the surface areas of the fins and improve heat-dissipation performance.

In this example, the bending plate bodies 11*f* are formed by pressing and bending the plate-like base materials in an approximately U shape in a cross-section view as shown in FIG. 25. In addition, the bending plate bodies 11*f* each have one lateral end surface 11*g* of an extending bending part 11*h* fixed to the support part, and thus the bending plate bodies 11*f* are raised in a radial or an approximately radial fashion such that the open parts of the approximately U shapes of the bending plate bodies 11*f* face radially outward. Since the bending parts 11*h* face in a direction of protrusion with the end surfaces 11*g* fixed to the support part, the bending plate bodies 11*f* can be extremely excellent in strength, and since the open parts face outward, the bending plate bodies 11*f* can act as heat sinks with excellent heat-dissipation properties.

In another preferred embodiment, the bending plate bodies 11*f* is laid down such that the bending parts are positioned on the bottom and fixed to the support part, and the open parts face in the direction of protrusion. FIG. 26 shows a modification example of the bending plate bodies 11*f* formed by pressing and bending plate-like base materials so as to have a plurality of bends like a corrugated plate. This makes it possible to further increase the heat-dissipation area and obtain a heat sink with excellent heat-dissipation properties. The bending plate bodies and the support part can be fixed by any of various fixing methods such as swaging, gluing, soldering, brazing, and other welding techniques. The bending plate bodies 11*f* of the heat sink member 11 shown in FIGS. 25 and 26 may have openings as appropriate in the bending parts and the fin surfaces (side surfaces, not vertical surfaces or end surfaces) depending on the necessity of an air flow or the like. The shape, number, and the like of the openings can be appropriately selected as necessary.

Next, a fourth embodiment of the present invention will be described with reference to FIGS. 27 to 31.

In this embodiment, the heat sink member 11 is attached to the base end-side surface 22*b* of the light source support stand 22, and dissipates heat generated at the light source and transferred from the light source support stand 22, from the outer surface thereof into the air within the housing. Instead of providing the plate-like fins 11*a* as in the first embodiment, plate-like solid columnar bodies 11*d* of high heat-conductive metal are used as fins. A plate-like base material of high heat-conductive metal constituting the support part 11*b* is pressed to swage and fix the columnar bodies 11*d* arranged in a radial or an approximately radial fashion to the plate-like base material, whereby the columnar bodies 11*d* are raised on the base end side of the plate-like base material.

Specifically, the columnar bodies 11*d* are swaged and fixed as shown in FIGS. 29 (*b*) and 29 (*c*) such that: attachment holes 11*k* (square holes) for inserting and fixing the plate-like columnar bodies 11*d* are formed in the plate-like base material constituting the support part 11*b*; step parts 11*i* are formed around the attachment holes 11*k*; the plate-like columnar bodies 11*d* are inserted into the attachment holes 11*k* in the support part 11*b* and set into assembly positions; and the step parts 11*i* are compressed from an axial direction and are plastically deformed toward centers of the attachment hole ilk, thereby to tighten and fix inner peripheral parts of the attachment holes to outer peripheral surfaces of the columnar bodies 11*d* as shown in FIG. 29 (*c*). In this arrangement, if penetration holes are formed in the base end parts of the plate-like columnar bodies 11*d* tightened and fixed to the support part 11*b*, the plastically deformed step parts 11*i* can enter into the penetration holes to further enhance a supporting strength. Besides the foregoing swaging and fixing method, any of various fixing methods can be used, such as gluing, soldering, blazing, other welding techniques, screwing, and pinning.

In this example, the columnar bodies 11*d* are straight (rectangular) flat plate members, but the columnar bodies 11*d* may be U-shaped or L-shaped in a cross-section view or may have a combination of these shapes as shown in FIG. 28. In this case, the columnar bodies 11*d* can be swaged and fixed in such a manner that the attachment holes 11*k* are sized to allow insertion of wider sections of lower end parts of the columnar bodies 11*d*, and the step parts 11*i* of the support part 11*b* are plastically deformed to attach the lower end parts of the columnar bodies 11*d* under pressure to the support part 11*b*. As a matter of the course, the columnar bodies U-shaped or L-shaped in a cross-section view may be placed on and fixed to the support part 11*b* by the fixing method as shown in FIG. 9.

In another preferred embodiment, as shown in FIG. 30, the step parts 11*i* are formed only on first sides of the columnar bodies 11*d* around the square attachment holes 11*k*, and are tightened and fixed only on the first sides. Accordingly, inner surfaces of the attachment holes 11*k* on the second sides can be left as cut planes, which makes it possible to keep favorable position accuracy and vertical degree of the columnar bodies 11*d* pressed onto the inner surfaces of the attachment holes 11*k*. In still another preferred embodiment, as shown in FIG. 31, the step parts 11*i* are on both sides of the columnar bodies 11*d*, and are pressed only on first sides and tightened and fixed only on the first sides. Accordingly, the step parts 11*i* are also formed on the second sides of the columnar bodies 11*d*, and both lateral ends of the columnar bodies 11*d* are positioned at both ends of the attachment holes 11*k*, and the step parts 11*i* are not formed at the both ends of the attachment holes 11*k* (in the examples of FIGS. 29 to 31, the step parts 11*i* are provided not along the entire width of the columnar bodies 11*d* but in predetermined intermediate areas of the columnar bodies 11*d* excluding the both ends as shown in FIG. 31 (*d*)). Thus, the columnar bodies 11*d* are supported between the bottom surface and the upper end of the support part 11*b* on the second sides (span d1 shown in FIG. 31 (*d*)), and a tightening pressure is applied from the first sides within the span to the columnar bodies 11*d* near at the lateral centers thereof. Therefore, the span becomes larger and pressure support is well-balanced at further favorable accuracy. In the examples of FIGS. 29 to 31, the step parts 11*i* are configured to apply pressure to the columnar bodies 11*d* in the predetermined intermediate areas excluding the both ends as described above. Alternatively, the width of the step parts 11*i* may be made identical to the width of the columnar bodies 11*d*. For example, as shown in FIG. 31 (*e*), it is preferred to narrow only the lower ends of the plate-like bodies 11*d* inserted into the attachment holes 11*k* so as to be identical to the width of the step parts 11*i*. In addition, as a matter of the course, when the holes 11*k* and the step parts 11*i* are in a relationship as shown in FIG. 31 (*d*) with the columnar bodies 11*d* as shown in FIG. 31 (*e*), the columnar bodies 11*d* can be supported within the span d1 at further favorable accuracy. FIG. 31 (*f*) shows a modification example in which the columnar bodies 11*d* have concave parts h1 into which the step parts are entered. The concave parts h1 may penetrate or not penetrate the columnar bodies 11*d*, and the number and shape of the concave parts h1 can be set appropriately depending on size, application, and the like. As a matter of the course, the concave parts h1 may not be square but may be round or odd-shaped or the like.

Embodiments of the present invention are described above. However, the present invention are not limited to these embodiments but can be carried out in various modes within the scope not deviating from the gist of the present invention.

REFERENCE SIGNS LIST

1 Lighting device
2 First case
3A Divided case
3A and 3B Divided case
4 Second case
4A Leading end-side case part
4B Base end-side case part
4C Divided case
6 Power circuit part
9 Regulation member
10 Fan motor
11, 11A, and 11B Heat sink member
11*a* Plate-like fin
11*b* Support part
11*c* Plate-like fin part
11*d* Columnar body
11*e* Thick-walled portion
11*f* Bending plate body
11*g* End surface
11*h* Bending part
11*i* Step part
11*k* Attachment hole
12 Pillar member
12*a* Screw hole
12*b* Screw hole
13 Support plate
20 Light source
21 Lens unit
21*b* Pawl
21*c* Base end part
22 Light source support stand
22*a* Leading end-side surface
22*b* Base end-side surface
22*c* Screw hole
23 Lens fixing member
23*a* Cylindrical part
23*b* Bottom surface part
23*c* Opening
23*d* Through hole
23*e* Engagement groove
23*f* Through hole
23*g* Through hole
24 Disc part
24*a* Screw hole
24*b* Through hole
24*c* Penetration hole
24*d* Avoidance groove
25 Bracket part
25*a* Screw hole
25*b* Engagement groove
30 Case main body
30*a* to 30*c* Bending portion
31 Fin
32 Penetration groove
40 Cap
40A Cap
41 Male screw part
42*a* Screw hole
42*b* Engagement groove
42*c* Engagement groove
43 Penetration hole
44 Through hole
45 Dust-proof net
46 Fixing piece
47 Penetration groove
48 Penetration groove
49 Adapter
49A Main body
49*a* Lock pawl
50 Housing
51 Air inlets/outlets
52 Air inlets/outlets
60 Resin case
60A Case main body
60B Cover body
60*a* Through hole
61 Circuit board
70 to 78 Attachment screw
80 Lead wire
81 Lead wire
83 Lead wire
84 Temperature sensor
85 Contact
87 Coil spring
88 Engagement groove
88*a* Longitudinal groove
88*b* Lateral groove
88*c* Return groove
90 Shield wall
91 Regulation plate

The invention claimed is:

1. A lighting device having a lens unit covering a light source at a leading end side thereof, wherein the light source is supported on a leading end-side surface of a light source support stand formed by a high heat-conductive member, a lens fixing member formed by a high heat-conductive member is interposed directly between the lens unit and the light source support stand, so as to be exposed on an outer surface, the light source is stored in an approximately sealed state by the light source support stand, the lens fixing member, and the lens unit, air inlets/outlets are provided on a wall surface of a housing nearer a base end side than the light source support stand, and heat generated at the light source is discharged by an air flow generated inside and outside the housing through the air inlets/outlets, from the base end-side surface of the light source support stand to the outside of the housing.

2. The lighting device according to claim 1, wherein a heat sink member formed by a high heat-conductive member is provided in a protruding state on the base end-side surface of the light source support stand, and heat generated at the light source is discharged by the air flow, from the base end-side surface of the light source support stand and the heat sink member to the outside of the housing.

3. The lighting device according to claim 2, wherein the heat sink member includes a plate-like support part fixed to the light source support stand and a plurality of fins provided in a protruding state on a surface of the support part opposite to the surface fixed to the light source support stand, and the fins are formed by pressing and folding a part of a plate-like base material of high heat-conductive metal toward the opposite side, and the remaining part of the plate-like base material with the fins are set as the support part.

4. The lighting device according to claim 3, wherein the plurality of fins are formed by providing a plurality of plate-like fin parts in a protruding state on an outer peripheral part of the plate-like base material, and the plurality of plate-like fin parts are pressed and folded at a predetermined angle and then raised toward the opposite side at the protruding base-end part or near the same so as not to interfere with each other.

5. The lighting device according to claim 4, wherein the plate-like fin parts are formed so as to protrude obliquely at a predetermined angle with respect to a radial direction of the plate-like base material.

6. The lighting device according to claim 2, wherein the heat sink member are set as a first heat sink, and a second heat sink that includes a plate-like support part and a plurality of fins and is approximately similar in shape to the first heat sink and smaller in size than the first heat sink, is overlapped and fixed on a surface of the first heat sink opposite to the surface on which the support part is fixed to the light source support stand.

7. The lighting device according to claim 2, wherein the heat sink member includes a plate-like support part fixed to the light source support stand and a plurality of fins provided in a protruding state on a surface of the support part opposite to the surface fixed to the light source support stand, and the fins are shaped into void or solid columnar bodies of high heat-conductive metal, and the columnar bodies are raised on the opposite side surface of a plate-like base material of high heat-conductive metal constituting the support part.

8. The lighting device according to claim 7, wherein the columnar bodies are raised on the plate-like base material by pressing the plate-like base material to swage and fix the columnar bodies.

9. The lighting device according to claim 7, wherein the plate-like base material is provided with attachment holes for inserting and fixing the columnar bodies, and a burring process is performed on the attachment holes to form thick-walled portions along inner peripheral edges of the attachment holes, and the thick-walled portions are compressed in an axial direction while the columnar bodies are inserted into the attachment holes, thereby to deform the thick-walled portions plastically toward centers of the attachment holes and attach the thick-walled portions under pressure onto outer peripheral surfaces of the columnar bodies, whereby the columnar bodies are swaged and fixed.

10. The lighting device according to claim 7, wherein the plate-like base material is provided with attachment holes for inserting and fixing the columnar bodies, and step parts are formed on entire or partial peripheries of the attachment holes, and the step parts are compressed in an axial direction while the columnar bodies are inserted into the attachment holes, thereby to deform the step parts plastically toward centers of the attachment holes and attach the inner peripheral parts of the attachment holes under pressure onto outer peripheral surfaces of the columnar bodies, whereby the columnar bodies are swaged and fixed.

11. The lighting device according to claim 2, wherein the heat sink member includes a plate-like support part fixed to the light source support stand and a plurality of fins provided in a protruding state on a surface of the support part opposite to the surface fixed to the light source support stand, and the fins are shaped into bending plate bodies by pressing and bending a plate-like base material of high heat-conductive metal, and the bending plate bodies are fixed to the opposite surface of the plate-like base material of high heat-conductive metal constituting the support part.

12. The lighting device according to claim 11, wherein first lateral end surfaces of extended bending parts in the bending plate bodies are fixed to the opposite side surface of the plate-like base material constituting the support part, thereby to extend the bending parts along a direction of protrusion of the bending plate bodies.

13. The lighting device according to claim 11 or 12, wherein the bending plate bodies are shaped into corrugated plates by pressing and bending the plate-like base material so as to have a plurality of bends.

14. The lighting device according to claim 2, wherein the heat sink member includes a plate-like support part fixed to the light source support stand and a plurality of fins provided in a protruding state on a surface of the support part opposite to the surface fixed to the light source support stand, and the fins are shaped into plate-like solid columnar bodies of high heat-conductive metal, and the columnar bodies are raised in a radial or an approximately radial fashion on the opposite surface of a plate-like base material of high heat-conductive metal constituting the support part.

15. The lighting device according to claim 14, wherein the plate-like base material is provided with attachment holes for inserting and fixing the columnar bodies, and step parts are formed on entire or partial peripheries of the attachment holes, and the step parts are compressed in an axial direction while the columnar bodies are inserted into the attachment holes, thereby to deform the step parts plastically toward centers of the attachment holes and attach the inner peripheral parts of the attachment holes under pressure onto outer peripheral surfaces of the columnar bodies, whereby the columnar bodies are swaged and fixed.

16. The lighting device according to claim 1, wherein a fan motor is arranged in the housing, and heat generated at the light source is discharged to the outside of the housing from the base end-side surface of the light source support stand, by a forcing air flow generated by the fan motor inside and outside of the housing through the air inlets/outlets.

17. The lighting device according to claim 16, wherein a power circuit part is arranged in the housing, and heat generated at the power circuit part is discharged to the outside of the housing by a forcing air flow generated by the fan motor.

18. The lighting device according to claim 17, wherein the power circuit part is connected by a plurality of pillar members to the base end-side surface of the light source support stand.

19. The lighting device according to claim 18, wherein the pillar members penetrate a support plate that has an opening at a central part thereof and supports the fan motor so as to close the opening, and the penetrated parts are fixed by swaging, whereby the power circuit part is fixed to the penetrated base end-side surface of the support plate.

20. The lighting device according to claim 1, wherein the housing includes a first case connected at a leading end part thereof to the light source support stand and a second case having a cap at a base end part thereof, and the first and second cases are provided with the air inlets/outlets at side wall parts thereof.

21. The lighting device according to claim 20, wherein the first case is formed by a high heat-conductive member.

22. The lighting device according to claim 20 or 21, wherein the first case includes a plurality of axially extending fins in a protruding state on an inner peripheral surface of a cylindrical case main unit, and a plurality of axially extending penetration grooves along the fins, and the penetration grooves function as the air inlets/outlets.

23. The lighting device according to claim 22, wherein the plurality of fins is formed by arranging a plurality of pairs of fins in a peripheral direction so as to protrude in an upturned trumpet shape in a cross-section view.

24. The lighting device according to claim 20, wherein the first case is formed by pressing a plate material.

25. The lighting device according to claim 20, wherein the first case is formed by assembling together two or three or more divided cases of the same structure.

26. The lighting device according to claim 1, wherein the lens fixing member is formed in a drawing-processed cylindrical shape with a bottom surface, an outer surface of the cylindrical part is exposed to the outside, the base end part of the lens unit is attached to an inner surface of the cylindrical part, and the bottom surface of the cylindrical part is fixed to the light source support stand.

* * * * *